US011066732B1

(12) United States Patent
Damm, III

(10) Patent No.: US 11,066,732 B1
(45) Date of Patent: Jul. 20, 2021

(54) ULTRA-HIGH STRENGTH STEEL WITH EXCELLENT TOUGHNESS

(71) Applicant: TimkenSteel Corporation, Canton, OH (US)

(72) Inventor: Edward Francis Damm, III, Akron, OH (US)

(73) Assignee: TimkenSteel Corporation, Canton, OH (US)

( * ) Notice: Subject to any disclaimer, the term of this patent is extended or adjusted under 35 U.S.C. 154(b) by 317 days.

(21) Appl. No.: 16/031,414

(22) Filed: Jul. 10, 2018

Related U.S. Application Data

(60) Provisional application No. 62/531,053, filed on Jul. 11, 2017.

(51) Int. Cl.

| | |
|---|---|
| ***C22C 38/46*** | (2006.01) |
| ***C22C 38/44*** | (2006.01) |
| ***C22C 38/02*** | (2006.01) |
| ***C22C 38/04*** | (2006.01) |
| ***C22C 38/48*** | (2006.01) |

(52) U.S. Cl.
CPC ..... *C22C 38/46* (2013.01); *C22C 38/02* (2013.01); *C22C 38/04* (2013.01); *C22C 38/44* (2013.01); *C22C 38/48* (2013.01); *C21D 2211/008* (2013.01)

(58) Field of Classification Search
CPC ..... C22C 38/46; C22C 38/02; C22C 38/04; C22C 38/44; C22C 38/48
USPC ..... 420/109
See application file for complete search history.

(56) References Cited

U.S. PATENT DOCUMENTS

| | | | | |
|---|---|---|---|---|
| 4,855,106 | A | 8/1989 | Katsumata et al. | |
| 5,595,610 | A * | 1/1997 | Maeda | C21D 1/78 148/233 |
| 6,092,989 | A | 7/2000 | Siga et al. | |
| 7,537,727 | B2 * | 5/2009 | Dilmore | C21D 1/18 148/663 |
| 10,450,621 | B2 | 10/2019 | Abrahams | |
| 2003/0116240 | A1 | 6/2003 | Fujita et al. | |
| 2015/0259771 | A1 * | 9/2015 | Vartanov | C21D 9/32 148/318 |
| 2016/0273067 | A1 * | 9/2016 | Monden | C22C 38/08 |

OTHER PUBLICATIONS

Materion (Technical Tidbits: Yield Strength and Other Near-Elastic Properties) (Year: 2012).*

* cited by examiner

*Primary Examiner* — Coris Fung
*Assistant Examiner* — Danielle Carda
(74) *Attorney, Agent, or Firm* — The Webb Law Firm

(57) ABSTRACT

An ultra-high strength, high toughness alloy steel comprising, by weight, 0.24% to 0.32% carbon, 1.0% manganese or less, 0.45% silicon or less, 1.60% to 1.85% chromium, 2.5% to 3.1% nickel, 0.40% to 0.65% molybdenum, and 0.025% to 0.05% vanadium, the balance being iron and unavoidable impurities; or 0.23% to 0.28% carbon, 1.0% manganese or less, 0.45% silicon or less, 2.05% to 2.4% chromium, 0.35% or less nickel, 0.85% to 1.15% molybdenum, and 0.03% or less vanadium, the balance being iron and unavoidable impurities; or 0.27% to 0.32% carbon, 1.0% manganese or less, 0.45% silicon or less, 0.7% to 1.0% chromium, 0.7% to 1.0% nickel, 0.7% to 1.0% molybdenum, 0.05% or less vanadium, and 0.05% or less niobium, the balance being iron and unavoidable impurities.

21 Claims, 15 Drawing Sheets

ULTRA-HIGH STRENGTH STEEL WITH EXCELLENT TOUGHNESS

CROSS REFERENCE TO RELATED APPLICATIONS

This application claims priority to U.S. Provisional Application Ser. No. 62/531,053 filed on Jul. 11, 2017, the disclosure of which is hereby incorporated in its entirety by reference.

BACKGROUND OF THE INVENTION

Field of the Invention

The present invention relates to alloy steels, and more particularly, to alloy steels possessing high strength in combination with high toughness.

Description of Related Art

Commercially available high strength or ultra-high strength steels are capable of achieving attractive combinations of strength, ductility, and toughness. Such steels include high strength, high toughness steels having yield strengths between 130 and 175 KSI with room temperature Charpy impact energy toughness values of 30 ft.-lbs. minimum, ultra-high strength steels having yield strengths greater than 175 KSI with room temperature Charpy impact energy toughness values of 30 ft.-lbs. or less, and ultra-high strength, high toughness steels having yield strengths in excess of 175 KSI with room temperature Charpy impact energy toughness values of greater than 30 ft.-lbs.

For applications requiring both ultra-high strength and high toughness, two steels having yield strengths in excess of 175 KSI and Charpy impact energy toughness values of greater than 30 ft.-lbs. are commercially available to licensees under the designations ES1 and AF9628. In addition, there are a range of specialty nickel-cobalt steel alloys that can achieve even higher strength and toughness combinations. However such nickel-cobalt steel alloys are produced at low production levels and are too expensive for many demanding applications requiring ultra-high strength with high toughness.

Table 1 summarizes the nominal chemical compositions for commercially available steels, Si—W and Si—Mo steel grades, and specialty nickel-cobalt steel grades.

TABLE 1

| Grade | C | Mn | Si | Cr | Ni | Mo | V | other |
|---|---|---|---|---|---|---|---|---|
| Commercial Grades | | | | | | | | |
| 4340 | 0.40 | 0.75 | 0.25 | 0.80 | 1.80 | 0.25 | 0.005 | — |
| D6A | 0.45 | 0.75 | 0.25 | 1.00 | 0.70 | 1.00 | 0.005 | — |
| HS220-27 | 0.30 | 0.87 | 0.25 | 0.87 | 1.82 | 0.42 | 0.075 | — |
| HS220-28 | 0.25 | 1.35 | 1.50 | 0.30 | 1.80 | 0.40 | 0.005 | — |
| 4333MV | 0.34 | 0.62 | 0.20 | 1.00 | 2.80 | 0.50 | 0.075 | — |
| EN27 | 0.24 | 0.65 | 0.25 | 1.25 | 2.75 | 0.25 | 0.005 | — |
| EN30B | 0.32 | 0.50 | 0.25 | 1.40 | 4.00 | 0.42 | 0.075 | — |
| Si-W and Si-Mo Grades | | | | | | | | |
| ES1 | 0.28 | 0.60 | 1.00 | 2.65 | 1.00 | 0.45 | 0.075 | 1.0 W |
| AF9628 | 0.27 | 0.58 | 1.00 | 2.74 | 1.00 | 0.95 | 0.056 | — |
| Specialty Ni-Co Grades | | | | | | | | |
| AerMet100 | 0.23 | — | — | 3.10 | 11.1 | 1.20 | — | 13.4 Co |
| AF1410 | 0.15 | 0.10 | 0.10 | 2.00 | 10.0 | 1.00 | — | 14.0 Co |
| HP 9-4-20 | 0.20 | 0.33 | 0.10 | 0.75 | 8.75 | 1.00 | 0.080 | 4.5 Co |

FIG. 1 shows the relationship between strength and toughness for these categories of steels and shows a darker banded region of strength and toughness combinations that commercially available special bar quality steels can achieve given the appropriate heat treatment. In addition, FIG. 2 shows the relationship between yield strength and room temperature, longitudinal Charpy impact energy toughness for these commercially available steels. Commercially available steel alloys that are frequently applied in demanding high strength, high toughness applications are shown as open symbols, steel alloys that were developed for penetrator munitions are shown as half-filled symbols, and specialty nickel-cobalt steels are shown as open symbols with crosses.

As can be seen from these figures, EN27 can achieve borderline ultra-high strength levels at high toughness levels, and HS220-27 can achieve borderline high toughness levels at ultra-high strength levels. However, neither achieves both ultra-high strength and high toughness.

The ES1 and AF9628 steel alloys developed for munitions both contain 1 wt. % silicon, and the ES1 steel alloy additionally contains 1 wt. % tungsten. Silicon additions at this level can result in poor surface quality in hot working, resulting in excessive cost to mitigate the poor surface finish. And, tungsten is an expensive and scarce alloy. Furthermore, scrap from production of tungsten steels has to be carefully segregated to avoid contamination of other manufacturing lots.

Specialty nickel-cobalt steels can achieve strength and toughness combinations that exceed the other steels as shown in FIG. 2. However, these alloys contain expensive additions of 4.5 to 14 wt. % of expensive, scarce cobalt and 9 to 11 wt. % of expensive, rare nickel. Furthermore, they are typically produced via a vacuum induction melting and vacuum arc re-melting process. These factors combine to make production times 2-4 times longer and raise costs to tens or hundreds of times more than a steel made using special bar quality production methods.

SUMMARY OF THE INVENTION

The present invention is directed to an alloy steel comprising, by weight, 0.24% to 0.32% carbon, 1.0% manganese or less, 0.45% silicon or less, 1.60% to 1.85% chromium, 2.5% to 3.1% nickel, 0.40% to 0.65% molybdenum, and 0.025% to 0.05% vanadium, the balance being iron and unavoidable impurities. The alloy steel may have one or more of the following properties: an ultimate tensile strength of 200 KSI or more, a 0.2% offset yield strength of 170 KSI or more, a room temperature, longitudinal Charpy impact energy toughness of 35 ft.-lbs. or more, a −40° F., longitudinal Charpy impact energy toughness of 25 ft.-lbs. or more, an elongation of 12% or more, a reduction of area at failure of 35% or more, a smooth sample rotating fatigue strength of 85 KSI or more, a U-notched rotating fatigue strength of 90 KSI or more, a hardness on the Rockwell C scale of 40 or more, and a microstructure comprising at least 90% martensite.

The present invention is also directed to an alloy steel comprising, by weight, 0.23% to 0.28% carbon, 1.0% manganese or less, 0.45% silicon or less, 2.05% to 2.4% chromium, 0.35% or less nickel, 0.85% to 1.15% molybdenum, and 0.03% or less vanadium, the balance being iron and unavoidable impurities. The alloy steel may have one or more of the following properties: an ultimate tensile strength of 220 KSI or more, a 0.2% offset yield strength of 175 KSI or more, a room temperature, longitudinal Charpy impact energy toughness of 35 ft.-lbs. or more, a −49° F., longitudinal Charpy impact energy toughness of 35 ft.-lbs. or more, an elongation of 13% or more, a reduction of area at failure of 40% or more, a U-notched rotating bending fatigue strength of 90 KSI or more, a hardness on the Rockwell C scale of 42 or more, and a microstructure comprising at least 90% martensite.

The present invention is also directed to an alloy steel comprising, by weight, 0.27% to 0.32% carbon, 1.0% manganese or less, 0.45% silicon or less, 0.7% to 1.0% chromium, 0.7% to 1.0% nickel, 0.7% to 1.0% molybdenum, 0.05% or less vanadium, and 0.05% or less niobium, the balance being iron and unavoidable impurities. The alloy steel may have one or more of the following properties: an ultimate tensile strength of 235 KSI or more, a 0.2% offset yield strength of 195 KSI or more, a room temperature, longitudinal Charpy impact energy toughness of 30 ft.-lbs. or more, a −40° F., longitudinal Charpy impact energy toughness of 25 ft.-lbs. or more, a elongation to failure of 12% or more, a reduction of area at failure of 40% or more, a smooth sample rotating bending fatigue strength of 80 KSI or more, a U-notched rotating bending fatigue strength of 100 KSI or more, a hardness on the Rockwell C scale of 42 or more, and a microstructure comprising at least 90% martensite.

DESCRIPTION OF THE INVENTION

Figure 1:
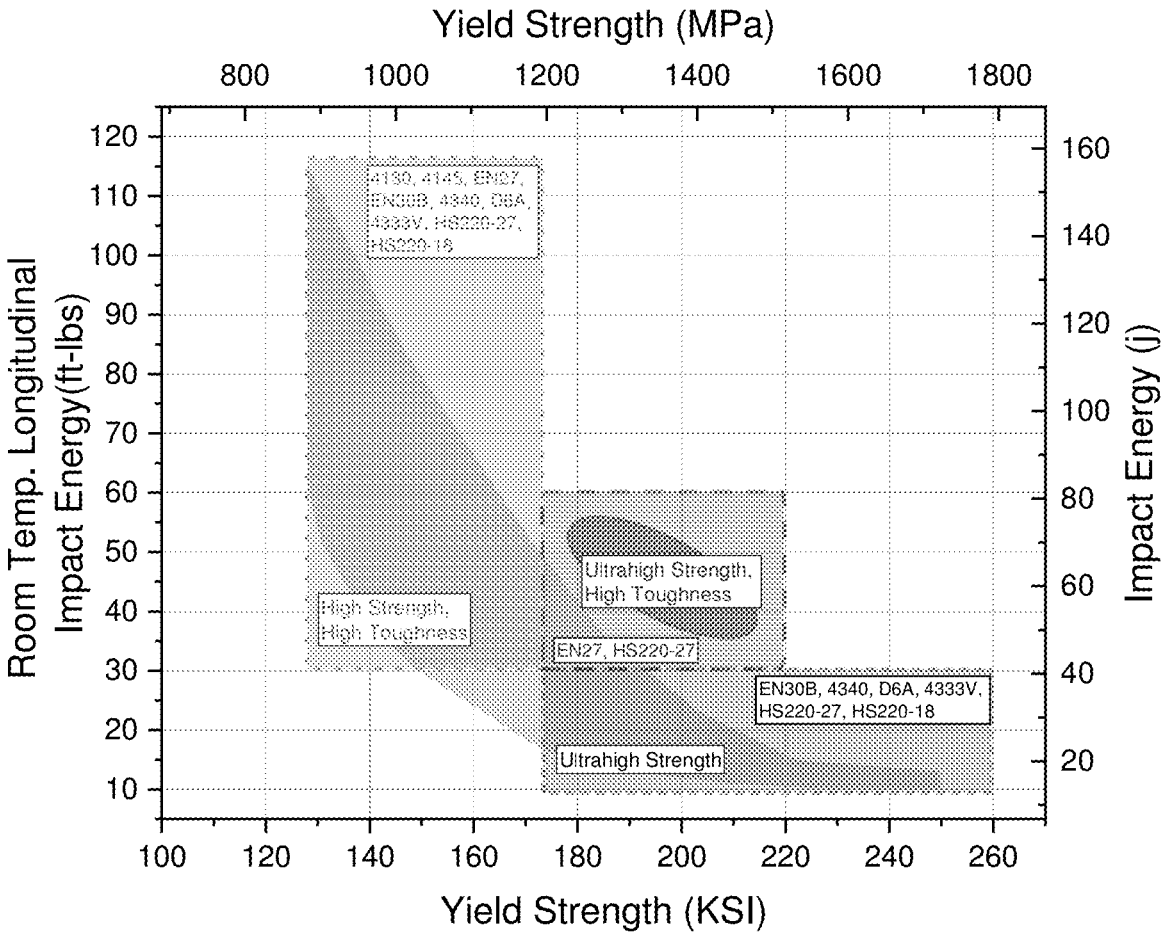
FIG. 1 is a graph showing regions of strength and toughness combinations for different classes of steels. The curved region within the high strength, high toughness region and the ultra-high strength region represents the current capabilities for commercially available alloy steels, and the oval shaped region within the ultra-high strength, high toughness region represents the inventive alloys.

As used herein, unless otherwise expressly specified, all numbers such as those expressing values, ranges, amounts or percentages may be read as if prefaced by the word "about", even if the term does not expressly appear. Any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1. Plural encompasses singular and vice versa. When ranges are given, any endpoints of those ranges and/or numbers within those ranges can be combined with the scope of the present invention. "Including", "such as", "for example" and like terms means "including/such as/for example but not limited to".

All percentages disclosed herein are in terms of weight.

The present invention is directed to alloy steels having both high strength in combination with high toughness.

Composition

Alloy Steel No. 1

In a first embodiment, the high strength, high toughness steel may contain the following alloying elements.

Carbon contributes to the strength, hardness, and hardenability capability of the alloy. Therefore, the alloy steel has a carbon content of at least 0.24%. However, too much carbon can decrease toughness and result in susceptibility to quench cracking. Therefore, the alloy steel has a carbon content of 0.32% or less and may have a carbon content of 0.27% or less or 0.26% or less. For example, the overall carbon content of the steel alloy may be 0.24-0.32%, 0.24-0.27% or 0.24-0.26%.

Manganese contributes to solid solution strengthening, toughness, and hardenability. The alloy steel need not contain any minimum manganese content; however, it may contain at least 0.45% or at least 0.5% manganese. At concentrations greater than 1.0% manganese contributes to alloy segregation and resultant loss of homogenous properties. Therefore, the manganese content of the alloy steel is 1.0% or less and may be 0.8% or less or 0.6% or less. For example, the overall manganese content of the steel alloy may be 1.0% or less, 0.45-0.8%, or 0.5-0.6%.

Silicon increases resistance to decomposition of retained austenite to carbide films and contributes to solid solution strengthening, hardenability, and temper resistance. The alloy steel need not contain any minimum silicon content; however, it may contain at least 0.15% or at least 0.2% silicon. However, too much silicon adversely affects ductility and toughness as well as hot worked surface quality. Therefore, the silicon content of the alloy steel is 0.45% or less and may be 0.35% or less or 0.3% or less. For example, the overall silicon content of the steel alloy may be 0.45% or less, 0.15-0.35%, or 0.2-0.3%.

Chromium enables carbide formation and provides solid solution strengthening and hardenability. Therefore, the alloy steel has a chromium content of at least 1.60% and may have a chromium content of at least 1.65% or at least 1.7%. The chromium content of the alloy steel is up to 1.85% and may be up to 1.8%. For example, the overall chromium content of the steel alloy may be 1.6-1.85%, 1.65-1.85%, or 1.7-1.8%.

Nickel contributes to hardenability and toughness, particularly at lower temperatures. Therefore, the alloy steel has a nickel content of at least 2.5% and may have a nickel content of at least 2.75% or at least 2.8%. However, nickel is a relatively expensive alloy addition. Therefore, the nickel content of the alloy steel is 3.1% or less and may be 2.95% or less or 2.9% or less. For example, the overall nickel content of the steel alloy may be 2.5-3.1%, 2.75-2.95%, or 2.8-2.9%.

Molybdenum enables carbide formation and contributes to solid solution strengthening, toughness, and hardenability. Therefore, the alloy steel has a molybdenum content of at least 0.40% and may have a molybdenum content of at least 0.45%. The molybdenum content of the alloy steel is up to 0.65% and maybe up to 0.60% or up to 0.55%. For example, the overall molybdenum content of the steel alloy may be 0.40-0.65%, 0.40-0.60%, or 0.45-0.55%.

Vanadium enables carbide formation and contributes to solid solution strengthening, hardenability, and grain refinement. Therefore, the alloy steel has a vanadium content of at least 0.025%. The vanadium content of the alloy steel is up to 0.05% and may be up to 0.035%. For example, the overall vanadium content of the steel alloy may be 0.025-0.05% or 0.025-0.035%.

Niobium forms NbC precipitates in austenite, which pin austenite grain boundaries which, in turn, improves strength and toughness. The niobium content of the alloy steel may be 0.01% or less or 0.005% or less.

The balance of the steel alloy is iron and unavoidable residual impurities found in commercial special bar quality grades of steels. Residual impurities in steel which include copper, aluminum, nitrogen, sulfur, calcium, oxygen, phosphorous, tin, arsenic and antimony should be kept as low as practical.

Aluminum is added to liquid steel in order to de-oxidize the steel. Nitrogen is absorbed in liquid steel from the atmosphere and the concentration is reduced during refining operations.

Residual amounts of aluminum present in the solid steel combine with the nitrogen to form AlN precipitates which aid in grain refinement and result in improvements in strength and toughness. However, coarse AlN precipitates nucleate voids during fracture, and hence too much aluminum and nitrogen, which can result in coarse AlN precipitates, may lower toughness. Thus, the aluminum content of the alloy steel is 0.035% or less and may be 0.01% or less and the nitrogen content of the alloy steel is 0.012% or less and may be 0.008% or less.

The copper content of the alloy steel is 0.25% or less and may be 0.2% or less. The sulfur content of the alloy steel is 0.025% or less and may be 0.008% or less. The calcium content of the alloy steel is 0.002% or less and may be 0.0005% or less. The oxygen content of the alloy steel is 0.0015% or less and may be 0.001% or less. The phosphorus, tin, arsenic and antimony contents are each 0.012% or less and in summation (P+Sn+As+Sb) are 0.04% or less and may be 0.03% or less.

The alloy steel may comprise 0.24% to 0.32% carbon, 1.0% manganese or less, 0.45% silicon or less, 1.60% to 1.85% chromium, 2.5% to 3.1% nickel, 0.40% to 0.65% molybdenum, and 0.025% to 0.05% vanadium, as shown in Table 2, with the balance being iron and unavoidable impurities as described above, or may comprise 0.24% to 0.27% carbon, 0.45% to 0.80% manganese, 0.15% to 0.35% silicon, 1.65% to 1.85% chromium, 2.75% to 2.95% nickel, 0.40% to 0.60% molybdenum, 0.025% to 0.05% vanadium, and 0.01% or less niobium, as shown in Table 2, with the balance being iron and unavoidable impurities as described above or may comprise 0.24% to 0.26% carbon, 0.5% to 0.6% manganese, 0.2% to 0.3% silicon, 1.7% to 1.8% chromium, 2.8% to 2.9% nickel, 0.45% to 0.55% molybdenum, 0.025% to 0.035% vanadium and 0.005% or less niobium, as shown in Table 2, with the balance being iron and unavoidable impurities as described above.

TABLE 2

| | Percentage by Weight (%) | | |
|---|---|---|---|
| Element | Example 1 | Example 2 | Example 3 |
| Carbon (C) | 0.24 to 0.32 | 0.24 to 0.27 | 0.24 to 0.26 |
| Manganese (Mn) | 1.0 or less | 0.45 to 0.80 | 0.5 to 0.60 |
| Silicon (Si) | 0.45 or less | 0.15 to 0.35 | 0.2 to 0.3 |
| Chromium (Cr) | 1.60 to 1.85 | 1.65 to 1.85 | 1.7 to 1.8 |
| Nickel (Ni) | 2.5 to 3.1 | 2.75 to 2.95 | 2.8 to 2.9 |
| Molybdenum (Mo) | 0.40 to 0.65 | 0.40 to 0.60 | 0.45 to 0.55 |
| Vanadium (V) | 0.025 to 0.05 | 0.025 to 0.05 | 0.025 to 0.035 |
| Niobium (Nb) | | 0.01% or less | 0.005% or less |

Alloy Steel No. 2

In a second embodiment, the high strength, high toughness steel may contain the following alloying elements.

Carbon contributes to the strength, hardness, and hardenability capability of the alloy. Therefore, the alloy steel has a carbon content of at least 0.23% and may be at least 0.24%. However, too much carbon can decrease toughness and result in susceptibility to quench cracking. Therefore, the alloy steel has a carbon content of 0.28% or less and may have a carbon content of 0.26% or less. For example, the overall carbon content of the steel alloy may be 0.23-0.28%, 23-26%, or 0.24-0.26%.

Manganese contributes to solid solution strengthening, toughness, and hardenability. The alloy steel need not contain any minimum manganese content; however, it may contain at least 0.45% or at least 0.5% manganese. At concentrations greater than 1.0% manganese contributes to alloy segregation and resultant loss of homogenous properties. Therefore, the manganese content of the alloy steel is 1.0% or less and may be 0.85% or less or 0.6% or less. For example, the overall manganese content of the steel alloy may be 1.0 or less, 0.45-0.85%, or 0.5-0.6%.

Silicon increases resistance to decomposition of retained austenite to carbide films and contributes to solid solution strengthening, hardenability, and temper resistance. The alloy steel need not contain any minimum silicon content; however, it may contain at least 0.15% or at least 0.2% silicon. However, too much silicon adversely affects ductility and toughness as well as hot worked surface quality. Therefore, the silicon content of the alloy steel is 0.45% or less and may be 0.35% or less or 0.3% or less. For example, the overall silicon content of the steel alloy may be 0.45% or less, 0.15-0.35%, or 0.2-0.3%.

Chromium enables carbide formation and provides solid solution strengthening and hardenability. Therefore, the alloy steel has a chromium content of at least 2.05% and may have a chromium content of at least 2.1% or at least 2.2%. The chromium content of the alloy steel is up to 2.4% and may be up to 2.3%. For example, the overall chromium content of the steel alloy may be 2.05-2.4%, 2.1-2.3%, or 2.2-2.3%.

Nickel contributes to hardenability and toughness, particularly at lower temperatures. However, nickel is a relatively expensive alloy addition. Therefore, the nickel content of the alloy steel is 0.35% or less and may be 0.25% or less or 0.15% or less.

Molybdenum enables carbide formation and contributes to solid solution strengthening, toughness, and hardenability. Therefore, the alloy steel has a molybdenum content of at least 0.85% and may have a molybdenum content of at least 0.9% or at least 0.95%. The molybdenum content of the alloy steel is up to 1.15% and may be up to 1.1% or 1.05%. For example, the overall molybdenum content of the steel alloy may be 0.85-1.15%, 0.9-1.1%, or 0.95-1.05%.

Vanadium enables carbide formation and contributes to solid solution strengthening, hardenability, and grain refinement. The vanadium content of the alloy steel may be 0.03% or less, 0.01% or less, or 0.005% or less.

Niobium forms NbC precipitates in austenite, which pin austenite grain boundaries which, in turn, improves strength and toughness. The niobium content of the alloy steel may be 0.01% or less or 0.005% or less.

The balance of the steel alloy is iron and unavoidable residual impurities found in commercial special bar quality grades of steels. Residual impurities in steel which include copper, aluminum, nitrogen, sulfur, calcium, oxygen, phosphorous, tin, arsenic and antimony should be kept as low as practical.

Aluminum is added to liquid steel in order to de-oxidize the steel. Nitrogen is absorbed in liquid steel from the atmosphere and the concentration is reduced during refining operations.

Residual amounts of aluminum present in the solid steel combine with the nitrogen to form AlN precipitates which aid in grain refinement and result in improvements in strength and toughness. However, coarse AlN precipitates nucleate voids during fracture, and hence too much aluminum and nitrogen, which can result in coarse AlN precipitates, may lower toughness. Thus, the aluminum content of the alloy steel is 0.035% or less and may be 0.01% or less and the nitrogen content of the alloy steel is 0.012% or less and may be 0.008% or less.

The copper content of the alloy steel is 0.25% or less and may be 0.2% or less. The sulfur content of the alloy steel is 0.025% or less and may be 0.008% or less. The calcium content of the alloy steel is 0.002% or less and may be 0.0005% or less. The oxygen content of the alloy steel is 0.0015% or less and may be 0.001% or less. The phosphorus, tin, arsenic and antimony contents are each 0.012% or less and in summation (P+Sn+As+Sb) are 0.04% or less and may be 0.03% or less.

The alloy steel may comprise 0.23% to 0.28% carbon, 1.0% manganese or less, 0.45% silicon or less, 2.05% to 2.4% chromium, 0.35% or less nickel, 0.85% to 1.15% molybdenum, and 0.03% or less vanadium, as shown in Table 3, with the balance being iron and unavoidable impurities as described above, or may comprise 0.23% to 0.26% carbon, 0.45% to 0.85% manganese, 0.15% to 0.35% silicon, 2.1% to 2.3% chromium, 0.25% or less nickel, 0.9% to 1.1% molybdenum, 0.01% or less vanadium, and 0.01% or less niobium, as shown in Table 3, with the balance being iron and unavoidable impurities as described above or may comprise 0.24% to 0.26% carbon, 0.5% to 0.6% manganese, 0.2% to 0.3% silicon, 2.2% to 2.3% chromium, 0.15% or less nickel, 0.95% to 1.05% molybdenum, 0.005% or less vanadium and 0.005% or less niobium, as shown in Table 3, with the balance being iron and unavoidable impurities as described above.

TABLE 3

| | Percentage by Weight (%) | | |
|---|---|---|---|
| Element | Example 1 | Example 2 | Example 3 |
| Carbon (C) | 0.23 to 0.28 | 0.23 to 0.26 | 0.24 to 0.26 |
| Manganese (Mn) | 1.0 or less | 0.45 to 0.85 | 0.5 to 0.6 |
| Silicon (Si) | 0.45 or less | 0.15 to 0.35 | 0.2 to 0.3 |
| Chromium (Cr) | 2.05 to 2.4 | 2.1 to 2.3 | 2.2 to 2.3 |
| Nickel (Ni) | 0.35 or less | 0.25 or less | 0.15 or less |
| Molybdenum (Mo) | 0.85 to 1.15 | 0.9 to 1.1 | 0.95 to 1.05 |
| Vanadium (V) | 0.03 or less | 0.01 or less | 0.005 or less |
| Niobium (Nb) | | 0.01 or less | 0.005 or less |

Alloy Steel No. 3

In a third embodiment, the high strength, high toughness steel may contain the following alloying elements.

Carbon contributes to the strength, hardness, and hardenability capability of the alloy. Therefore, the alloy steel has a carbon content of at least 0.27% and may be at least 0.28%. However, too much carbon can decrease toughness and result in susceptibility to quench cracking. Therefore, the alloy steel has a carbon content of 0.32% or less and may have a carbon content of 0.31% or less or 0.3% or less. For example, the overall carbon content of the steel alloy may be 0.27-0.32%, 0.28-0.31%, or 0.28-0.3%.

Manganese contributes to solid solution strengthening, toughness, and hardenability. The alloy steel need not contain any minimum manganese content; however, it may contain at least 0.8% or at least 0.87% manganese. At concentrations greater than 1.0% manganese contributes to alloy segregation and resultant loss of homogenous properties. Therefore, the manganese content of the alloy steel is 1.0% or less and may be 0.95% or less or 0.93% or less. For example, the overall manganese content of the steel alloy may be 1.0 or less, 0.8-0.95%, or 0.87-0.93%.

Silicon increases resistance to decomposition of retained austenite to carbide films and contributes to solid solution strengthening, hardenability, and temper resistance. The alloy steel need not contain any minimum silicon content; however, it may contain at least 0.15% or at least 0.2% silicon. However, too much silicon adversely affects ductility and toughness as well as hot worked surface quality. Therefore, the silicon content of the alloy steel is 0.45% or less and may be 0.35% or less or 0.3% or less. For example, the overall silicon content of the steel alloy may be 0.45% or less, 0.15-0.35%, or 0.2-0.3%.

Chromium enables carbide formation and provides solid solution strengthening and hardenability. Therefore, the alloy steel has a chromium content of at least 0.7% and may have a chromium content of at least 0.76%. The chromium content of the alloy steel is up to 1.0% and may be up to 0.95% or up to 0.84%. For example, the overall chromium content of the steel alloy may be 0.7-1.0%, 0.7-0.95%, or 0.76-0.84%.

Nickel contributes to hardenability and toughness, particularly at lower temperatures. Therefore, the alloy steel has a nickel content of at least 0.7% and may have a nickel content of at least 0.76%. However, nickel is a relatively expensive alloy addition. Therefore, the nickel content of the alloy steel is 1.0% or less and may be 0.95% or less or 0.84% or less. For example, the overall nickel content of the steel alloy may be 0.7-1.0%, 0.7-0.95%, or 0.76-0.84%.

Molybdenum enables carbide formation and contributes to solid solution strengthening, toughness, and hardenability. Therefore, the alloy steel has a molybdenum content of at least 0.7% and may have a molybdenum content of at least 0.76%. The molybdenum content of the alloy steel is up to 1.0% and maybe up to 0.95% or up to 84%. For example, the overall molybdenum content of the steel alloy may be 0.7-1.0%, 0.7-0.95%, or 0.76-0.84%.

Vanadium enables carbide formation and contributes to solid solution strengthening, hardenability, and grain refinement. The vanadium content of the alloy steel may be 0.05% or less, 0.01% or less, or 0.005% or less.

Niobium forms NbC precipitates in austenite, which pin austenite grain boundaries which, in turn, improves strength and toughness. The niobium content of the alloy steel may be 0.05% or less, 0.01% or less, or 0.005% or less.

The balance of the steel alloy is iron and unavoidable residual impurities found in commercial special bar quality grades of steels. Residual impurities in steel which include copper, aluminum, nitrogen, sulfur, calcium, oxygen, phosphorous, tin, arsenic and antimony should be kept as low as practical.

Aluminum is added to liquid steel in order to de-oxidize the steel. Nitrogen is absorbed in liquid steel from the atmosphere and the concentration is reduced during refining operations.

Residual amounts of aluminum present in the solid steel combine with the nitrogen to form AlN precipitates which aid in grain refinement and result in improvements in strength and toughness. However, coarse AlN precipitates nucleate voids during fracture, and hence too much aluminum and nitrogen, which can result in coarse AlN precipitates, may lower toughness. Thus, the aluminum content of the alloy steel is 0.035% or less and may be 0.01% or less and the nitrogen content of the alloy steel is 0.012% or less and may be 0.008% or less.

The copper content of the alloy steel is 0.25% or less and may be 0.2% or less. The sulfur content of the alloy steel is 0.025% or less and may be 0.008% or less. The calcium content of the alloy steel is 0.002% or less and may be 0.0005% or less. The oxygen content of the alloy steel is 0.0015% or less and may be 0.001% or less. The phosphorus, tin, arsenic and antimony contents are each 0.012% or less and in summation (P+Sn+As+Sb) are 0.04% or less and may be 0.03% or less.

The alloy steel may comprise 0.27% to 0.32% carbon, 1.0% manganese or less, 0.45% silicon or less, 0.7% to 1.0% chromium, 0.7% to 1.0% nickel, 0.7% to 1.0% molybdenum, 0.05% or less vanadium, and 0.05% or less niobium, as shown in Table 4, with the balance being iron and unavoidable impurities as described above, or may comprise 0.28% to 0.31% carbon, 0.8% to 0.95% manganese, 0.15% to 0.35% silicon, 0.7% to 0.95% chromium, 0.7% to 0.95% nickel, 0.7% to 0.95% molybdenum, 0.01% or less vanadium, and 0.01% or less niobium, as shown in Table 4, with the balance being iron and unavoidable impurities as described above or may comprise 0.28% to 0.3% carbon, 0.87% to 0.93% manganese, 0.2% to 0.3% silicon, 0.76% to 0.84% chromium, 0.76% to 0.84% nickel, 0.76% to 0.84% molybdenum, 0.005% or less vanadium and 0.005% or less niobium, as shown in Table 4, with the balance being iron and unavoidable impurities as described above.

TABLE 4

| | Percentage by Weight (%) | | |
|---|---|---|---|
| Element | Example 1 | Example 2 | Example 3 |
| Carbon (C) | 0.27 to 0.32 | 0.28 to 0.31 | 0.28 to 0.3 |
| Manganese (Mn) | 1.0 or less | 0.8 to 0.95 | 0.87 to 0.93 |
| Silicon (Si) | 0.45 or less | 0.15 to 0.35 | 0.2 to 0.3 |
| Chromium (Cr) | 0.7 to 1.0 | 0.7 to 0.95 | 0.76 to 0.84 |
| Nickel (Ni) | 0.7 to 1.0 | 0.7 to 0.95 | 0.76 to 0.84 |
| Molybdenum (Mo) | 0.7 to 1.0 | 0.7 to 0.95 | 0.76 to 0.84 |
| Vanadium (V) | 0.05 or less | 0.01 or less | 0.005 or less |
| Niobium (Nb) | 0.05 or less | 0.01 or less | 0.005 or less |

Processing

The alloy steel compositions of the present invention may be manufactured by a range of processes including; Electric Arc Furnace (EAF) melting of scrap steel, Vacuum Ladle Refining (VLR) and casting; Argon Oxygen Decarburization (AOD), Vacuum Ladle Refining (VLR) and casting; Electro Slag Remelting (ESR) and casting; Vacuum Induction Melting (VIM) and casting; or Vacuum Arc Remelting (VAR) and casting. In one example, the alloy steel was manufactured via the VIM process. In another example, one of the alloy steels was manufactured via the EAF and VLR process.

The alloy steel compositions of the present invention may be manufactured to intermediate or final geometric configurations by static casting, forging, or hot rolling to bar, seamless mechanical tubing, or plate, followed by a thermal treatment process that includes hardening and tempering. If static casting is used to manufacture the alloy steel composition, a Hot Isostatic Press (HIP) step may be performed prior to thermal treatment in order to consolidate remnant solidification voids.

In an optional initial step, the alloy steel can be thermally treated by subjecting the steel to a normalization thermal treatment process in a typical temperature range between 1650 to 1750° F., prior to hardening and tempering. In the normalization thermal treatment process, the alloy steel is heated to above the upper critical temperature, $A_{c3}$, to form primarily austenite followed by air cooling to ambient temperature.

The hardening thermal treatment comprises heating the alloy steel to a temperature above the upper critical temperature, $A_{c3}$, in order to form primarily austenite (austenitizing) although small amounts of carbide or nitride precipitates may be present, for example, vanadium carbo-nitride, niobium carbo-nitride, or titanium nitride precipitates. The treatment is performed at a temperature that is at least 1575° F. and is up to 1675° F., for example, 1575-1675° F. or 1600-1650° F. Alternatively, the treatment temperature may be 25 to 75° F. below the normalization temperature if normalization was applied. The hardening thermal treatment includes a quenching treatment from the austenitization temperature. The quenching medium must have sufficient capability to cool the alloy steel to a temperature below the martensite start temperature, $M_s$, without forming significant amounts of non-martensitic constituents and phases. The quench medium and section size employed should allow for at least 90% martensite to form. Up to 10% in sum of retained austenite, ferrite, pearlite and/or bainite may be present. Section size and alloy hardenability affect the quench medium and quench process that is used to fully harden the steel. Generally, for the alloy steels herein, an agitated water quench for section sizes up to 10 inches is sufficient. An optional Cryogenic treatment can be applied, wherein the quenched component is further cooled to temperatures between 32 and −321° F. in order to transform trace amounts of retained austenite to martensite prior to tempering.

The tempering process is applied after hardening and comprises heating the alloy steel at a rate of 10° F. per second or less to a temperature of at least 300° F. and up to 550° F., for example, 300-550° F. or 350-425° F., and holding for a duration that is sufficient to allow all regions of the component to achieve the desired tempering temperature. As a result, the tempering time is dependent on the largest cross section of the component. After tempering, the component can be cooled in air, or, optionally, via a faster method, to ambient temperature.

When components of the alloy steel are thermally processed with the foregoing method, they possess at least one of the following properties.

Properties

Alloy Steel No. 1

The ultimate tensile strength is 200 KSI or more and may be 210 KSI or more or 225 KSI or more. The 0.2% offset yield strength is 170 KSI or more and may be 180 KSI or more or 190 KSI or more. The room temperature, longitudinal Charpy impact energy toughness is 35 ft.-lbs. or more and may be 40 ft.-lbs. or more or 45 ft.-lbs. or more. The −49° F., longitudinal Charpy impact energy toughness is 25 ft.-lbs. or more and may be 35 ft.-lbs. or more. The plane strain fracture toughness, $K_{1C}$, is 90 KSI $\sqrt{in}$ or more and may be 100 KSI $\sqrt{in}$ or more. The elongation to failure is 12% or more and may be 14% or more or 15% or more. The reduction of area at failure is 35% or more and may be 45% or more or 50% or more. The smooth sample rotating bending fatigue strength is 85 KSI or more and may be 95 KSI or more. The $K_t$=1.5 U-notched rotating bending fatigue strength is 90 KSI or more and may be 100 KSI or more. The hardness on the Rockwell C scale is 40 or more and may be 42 or more. In addition, these properties can be achieved at the quarter section location in heavy cross sections of about 10 inches or more.

Alloy Steel No. 2

The ultimate tensile strength is 220 KSI or more and may be 230 KSI or more. The 0.2% offset yield strength is 175 KSI or more and may be 180 KSI or more or 185 KSI or more. The room temperature, longitudinal Charpy impact energy toughness is 35 ft.-lbs. or more and may be 40 ft.-lbs. or more or 45 ft.-lbs. or more. The −49° F., longitudinal Charpy impact energy toughness is 35 ft.-lbs. or more and may be 40 ft.-lbs. or more. The plane strain fracture toughness, $K_{1C}$, is 90 KSI $\sqrt{in}$ or more and may be 100 KSI $\sqrt{in}$ or more. The elongation to failure is 13% or more and may be 14% or more. The reduction of area at failure is 40% or more and may be 45% or more or 50% or more. The $K_t$=1.5 U-notched rotating bending fatigue strength is 90 KSI or more and may be 100 KSI or more. The hardness on the Rockwell C scale is 42 or more and may be 43 or more or 46 or more. In addition, these properties can be achieved at the quarter section location in heavy cross sections of about 7 inches or more.

Alloy Steel No. 3

The ultimate tensile strength is 235 KSI or more and may be 245 KSI or more or 250 KSI or more. The 0.2% offset yield strength is 195 KSI or more and may be 205 KSI or more or 212 KSI or more. The room temperature, longitudinal Charpy impact energy toughness is 30 ft.-lbs. or more and may be 40 ft.-lbs. or more. The −40° F., longitudinal Charpy impact energy toughness is 25 ft.-lbs. or more and may be 30 ft.-lbs. or more. The plane strain fracture toughness, $K_{1C}$, is 90 KSI $\sqrt{in}$ or more and may be 100 KSI $\sqrt{in}$ or more. The elongation to failure is 12% or more and may be 13% or more or 14% or more. The reduction of area at failure is 40% or more and may be 45% or more. The smooth sample rotating bending fatigue strength is 80 KSI or more and may be 90 KSI or more. The $K_t$=1.5 U-notched rotating bending fatigue strength is 100 KSI or more and may be 110 KSI or more. The hardness on the Rockwell C scale is 42 or more and may be 43 or more or 46 or more. In addition, these properties can be achieved at the quarter section location in heavy cross sections of about 2 inches or more.

The formation of metastable martensite upon hardening generates a high concentration of dislocations which contribute to strength and act as temper carbide nucleation sites. The relatively low tempering temperature range in combination with the high dislocation concentration results in a fine dispersion of metastable transition carbides ($Fe_{2.4}C$, $Fe_2C$, $Fe_4C$), and cementite ($Fe_3C$) in a tempered martensite matrix. In this structure, carbon can also cluster at preferred locations within the Martensite matrix. This results in the observed exceptional strength and toughness properties. The alloy steel is essentially void of course dispersions of common alloy carbides, such as $M_{23}C_6$, $M_7C_3$, or $M_2C$ carbides which form at higher tempering temperatures, and which can limit strength and toughness.

Figure 2:
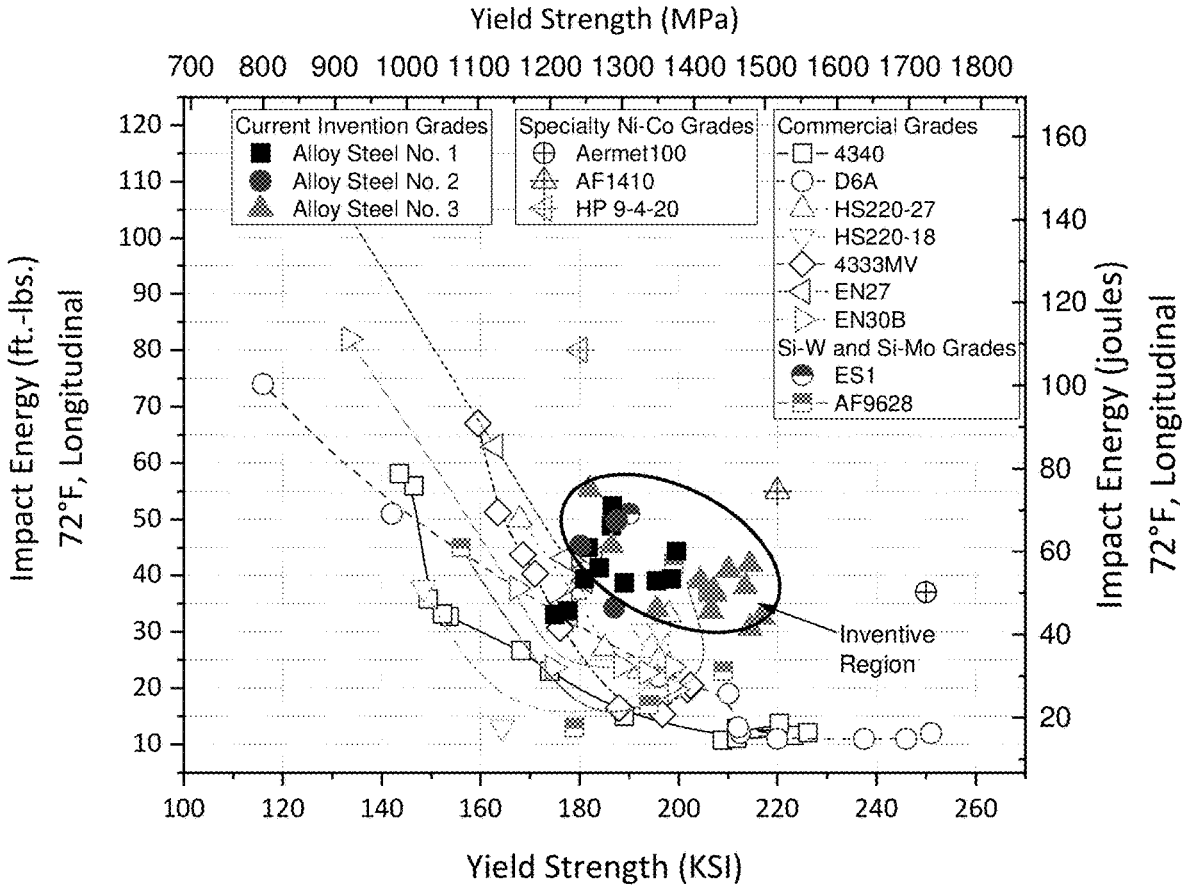
FIG. 2 is a graph showing the relationship between room temperature, longitudinal Charpy impact energy toughness and yield strength for various commercially available steels. The range of strength and toughness combinations for each steel is shown at various tempering temperatures, which affect both yield strength and toughness. The values for the inventive alloys, which show ultra-high strength and high toughness, are also included.
Figure 3:
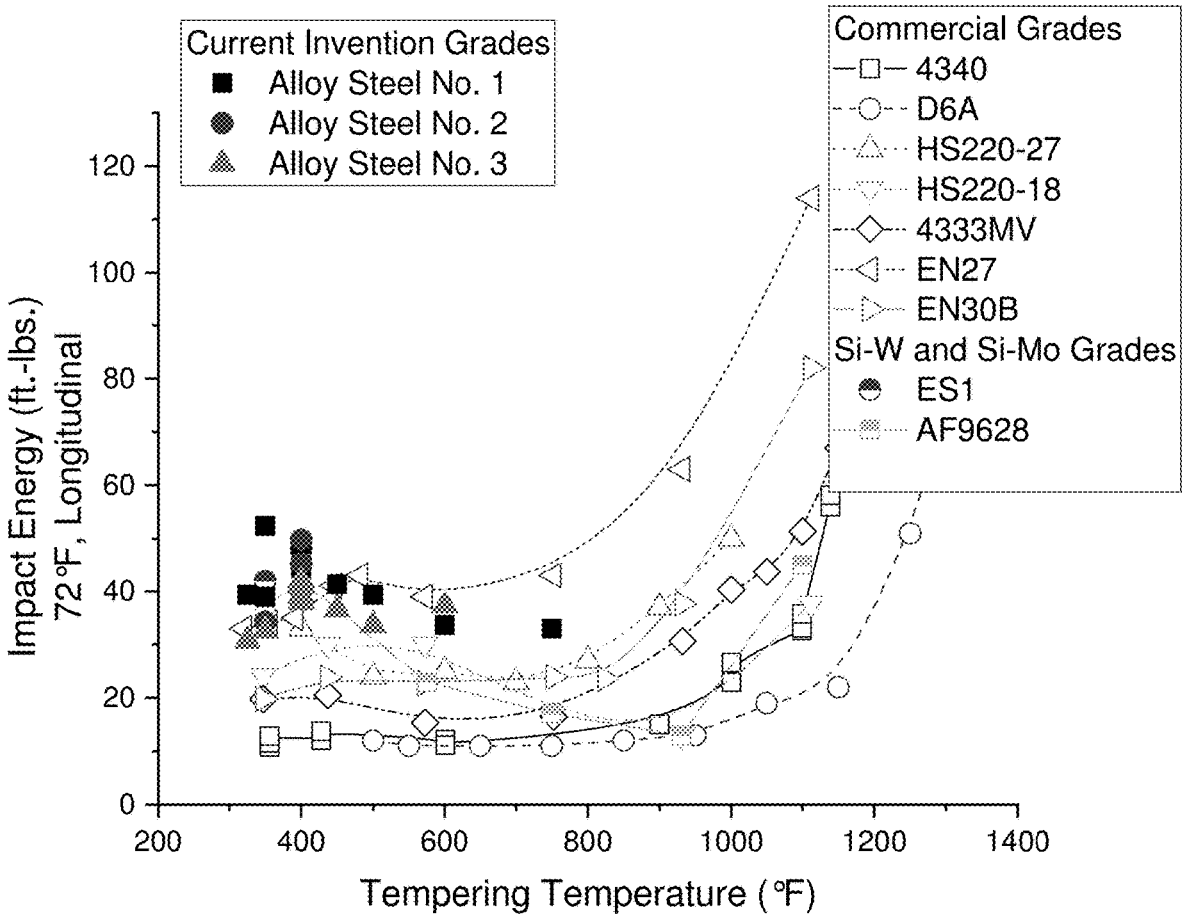
FIG. 3 is a graph showing the relationship between room temperature, longitudinal Charpy impact energy toughness and tempering temperature for a range of commercially available steels and the inventive alloys.
Figure 4:
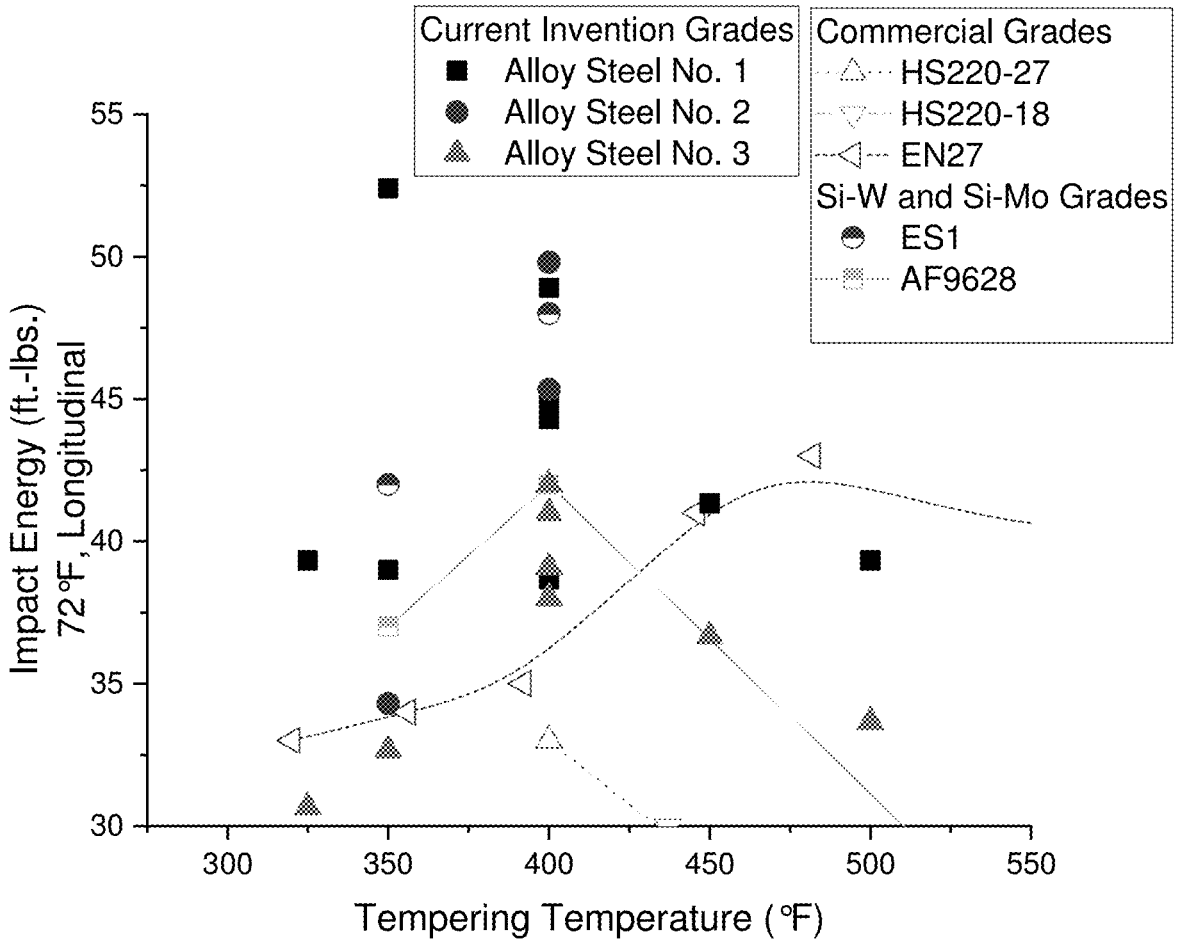
FIG. 4 is a graph showing the relationship between room temperature, longitudinal Charpy impact energy toughness and tempering temperature for the region of the graph of FIG. 3 that includes the values for the inventive alloys.
Figure 5:
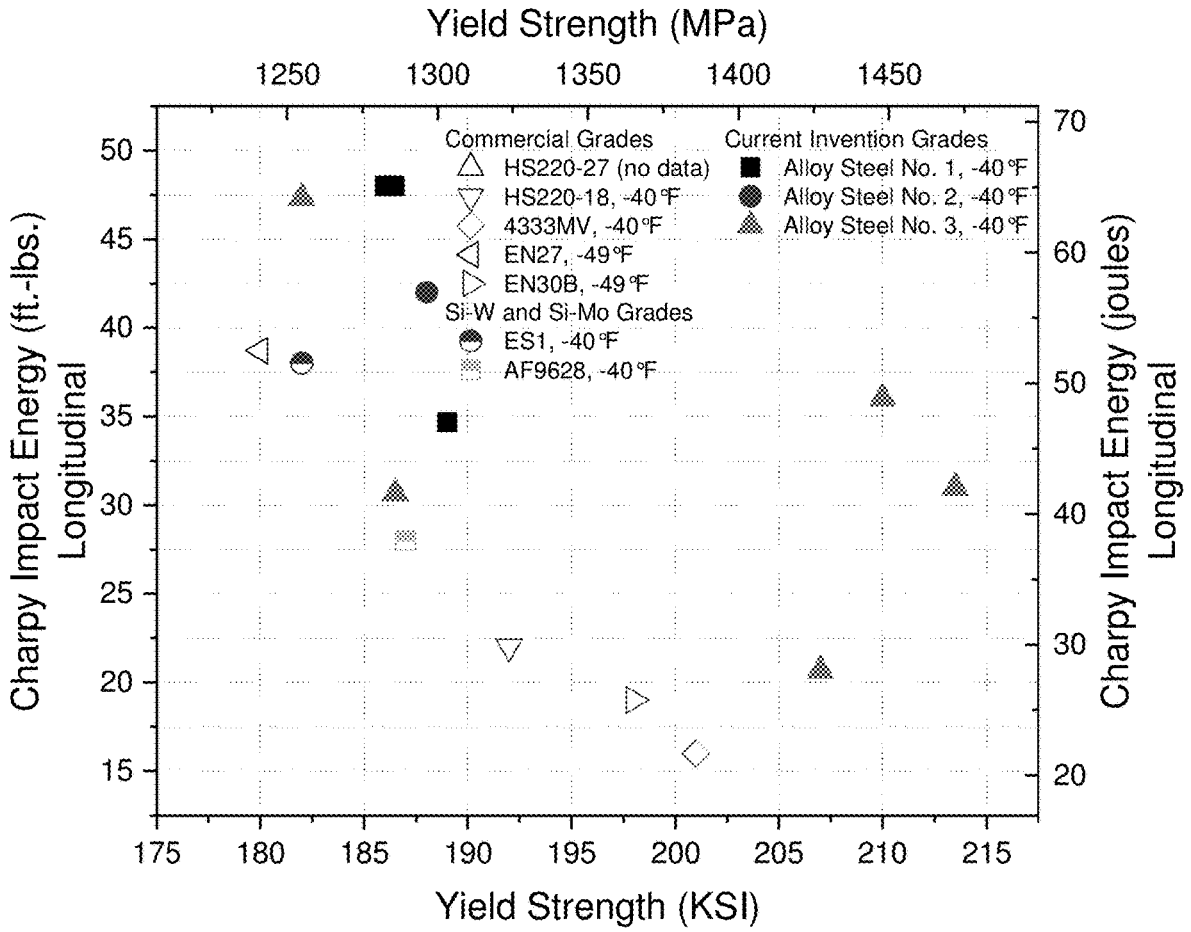
FIG. 5 is a graph showing the relationship between low temperature, longitudinal Charpy impact energy toughness and yield strength for various commercially available steels and the inventive alloys. The low temperature for the Charpy impact energy toughness is either −40° F. or −49° F. as shown in the legend.

As can be seen in FIGS. 2 and 3, the alloy steels have a combination of strength and toughness that is not present in the prior art alloy steels and that can be achieved at relatively low tempering temperatures. While EN27 steel exhibits similar impact toughness, the yield strength of EN27 is only about 175-180 KSI. FIG. 5 shows that the low temperature Charpy impact energy toughness for the alloy steels of the present invention are also significantly improved over the prior art alloy steels. AF9628 and ES1 steels exhibit similar impact toughness and yield strength combinations as the inventive alloy steels. The key difference is that AF9628 and ES1 are alloyed with 1 wt. % silicon. Silicon at this level can result in poor surface quality in wrought steels because it promotes grain boundary oxidation at hot working temperatures. Silicon can be effective at delaying the decomposition of retained austenite to ferrite and cementite at temperatures in the 500-700° F. range, but when tempering in the range of 350 to 425° F. for the current inventive alloys minimal retained austenite decomposition is expected. As a result Alloy Steels 1, 2 and 3 presented herein contain only residual silicon levels below 0.45%. In addition, ES1 is alloyed with 1% by weight of tungsten, which is a scarce and expensive alloy resulting in higher costs than the inventive alloys herein.

Applications

The alloy steel may be used in a variety of applications including a broad range of ground engaging applications such as oil field drilling equipment, mining equipment, and construction equipment. Such equipment would include drill components, drill string components, and sub-assembly components for a drill string. The alloy steel also has a combination of strength and toughness desirable for applications such as standard or penetrator munitions, gears, shafts and similar mechanical power transmission components that are subjected to relatively high loads or transient impact loading and/or are of a section size that requires high hardenability in excess of 10 inches. Such mechanical power transmission components are used in nearly every industry including, but not limited to automotive, energy, oil and gas exploration and production, manufacturing, aerospace, mining, and construction. The alloy steels can be used in a through hardened condition or in surface hardened conditions; for example, as carburized, induction hardened, or nitrided components.

EXAMPLES

Example 1 of Alloy Steel No. 1—Vacuum Induction Melted

Approximately 100 lbs. of a sample with a chemical composition designated as Example 1 of Alloy Steel No. 1, shown in Table 5, was manufactured in a vacuum induction melting facility and poured into an ingot mold. The approximate dimensions of the ingot were 5.5 inches in diameter and 13 inches long, yielding approximately 85 lbs. of material for testing. The ingot was forged along its axis to an approximately 2.25 inch square section yielding a total length of slightly less than about 5 feet. Saw cut test coupons were sectioned from the forged square bar for thermal treatment and production of samples for tensile testing, Charpy impact testing, and rotating bending fatigue testing.

TABLE 5

| Example 1 of Alloy Steel No. 1 | |
|---|---|
| Element | Percentage by Weight (%) |
| Carbon (C) | 0.25 |
| Manganese (Mn) | 0.58 |
| Silicon (Si) | 0.21 |
| Chromium (Cr) | 1.77 |
| Nickel (Ni) | 2.88 |
| Molybdenum (Mo) | 0.50 |
| Vanadium (V) | 0.032 |
| Niobium (Nb) | 0.004 |
| Aluminum (Al) | 0.012 |

TABLE 5-continued

| Example 1 of Alloy Steel No. 1 | |
|---|---|
| Element | Percentage by Weight (%) |
| Nitrogen (N) | 0.0076 |
| Iron (Fe) | Balance |

Thermal treatment parameters and the resulting physical properties for Alloy Steel No. 1 are summarized in Table 6. Four different thermal treatment conditions, identified as conditions 1A, 1B, 1C, and 1D, were produced and tested. Conditions 1A and 1B where not normalized and had different austenitizing or tempering temperatures. Conditions 1C and 1D were normalized and received the same austenitizing and tempering treatments with the exception that 1C was quenched first in water and then in liquid nitrogen until the liquid nitrogen ceased boiling and condition 1D was only quenched in water.

Figure 6:
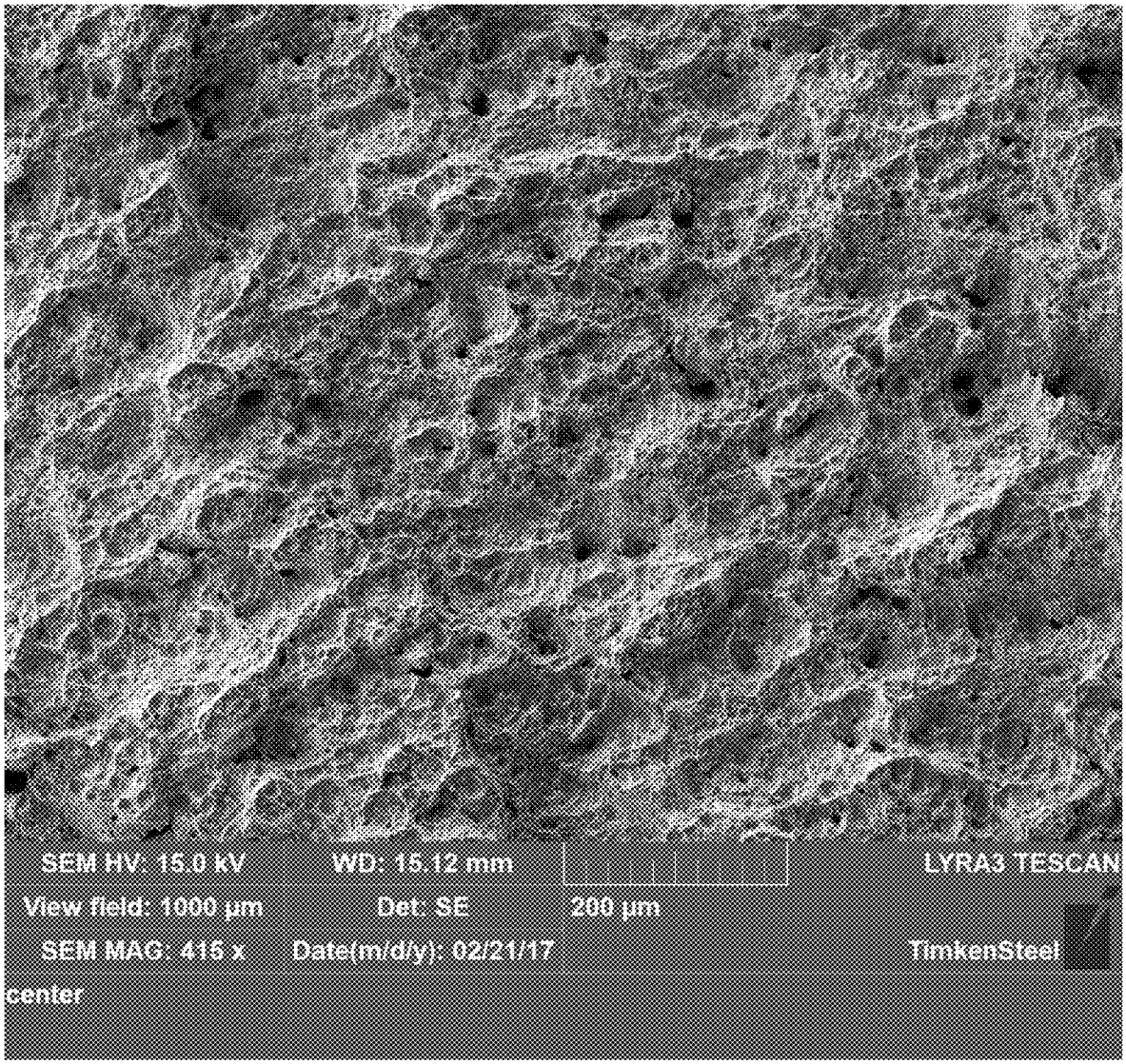
FIG. 6 shows a scanning electron microscopy (SEM) image from near the center of the Charpy fracture surface for Condition 1D (Table 6) of Example 1 of Steel Alloy No. 1. The sample orientation was longitudinal and the sample was broken at 72° F. The fracture consists entirely of tough ductile micro void coalescence with no evidence of brittle cleavage or intergranular fracture modes.

The water quenched conditions (1A, 1B, and 1D) exhibited yield strengths of 182 to 187 KSI and room temperature, longitudinal Charpy impact energy toughness of 45 to 52.4 ft.-lbs. The liquid nitrogen quenched condition (1C) exhibited a yield strength of 200 KSI and room temperature, longitudinal Charpy impact energy toughness of 44.3 ft.-lbs. FIG. 6 shows a scanning electron microscopy (SEM) image from near the center of the Charpy fracture surface for Steel Alloy No. 1 treated according to Condition 1D. The sample orientation was longitudinal and the sample was broken at 72° F. The fracture consists entirely of tough ductile micro void coalescence with no evidence of brittle cleavage or intergranular fracture modes.

Conditions 1A, 1B, and 1D were also tested at −4° F. and exhibited longitudinal Charpy impact energy toughness of 49 to 51 ft.-lbs., and Condition 1D was also tested at −49° F. and exhibited longitudinal Charpy impact energy toughness of about 48 ft.-lbs.

Condition 1D was also plane strain fracture toughness tested per ASTM E399 and exhibited a $K_{IC}$ fracture toughness of about 119 KSI$\sqrt{\text{in}}$.

Figure 9:
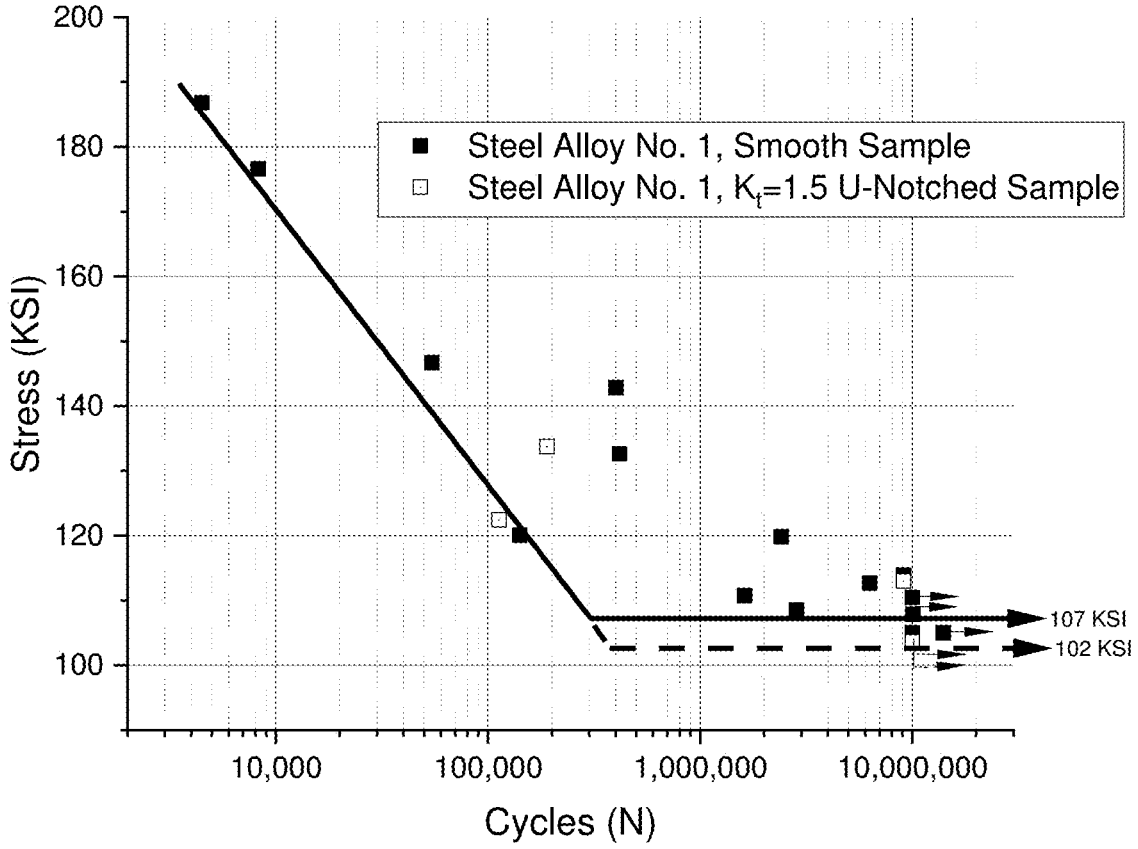
FIG. 9 is a graph showing the smooth sample and U-notched ($K_t$=1.5) rotating bending fatigue data for Examples 1 and 2 of Inventive Alloy No. 1, respectively.

Condition 1D was subjected to U-notched rotating bending fatigue testing. FIG. 9 shows the U-notched rotating bending fatigue data. Testing was completed with a U-notched sample which had a stress concentration factor of 1.5. The stress presented is the applied stress multiplied by the U-notch stress concentration factor. The sample exhibited a U-notched rotating bending fatigue strength run-out to $10^7$ cycles of 102 KSI.

TABLE 6

| Example 1 of Alloy Steel No. 1 Thermal Treatment Parameters and Resulting Physical Properties | | | | |
|---|---|---|---|---|
| Condition ID | 1A | 1B | 1C | 1D |
| Thermal Treatment Parameters | | | | |
| Normalize temp. (° F.) | n/a | n/a | 1675 | 1675 |
| Normalize time (hrs.) | n/a | n/a | 1.25 | 1.25 |
| Austenitize temp. (° F.) | 1675 | 1650 | 1600 | 1600 |
| Austenitize time (hrs.) | 1.25 | 1.25 | 1.25 | 1.25 |
| Quench medium | water | water | Liq. Nit. | water |
| Temper temp. (° F.) | 350 | 400 | 400 | 400 |
| Temper time (hrs.) | 2.25 | 2.25 | 2.25 | 2.25 |
| Physical Properties | | | | |
| Tensile Strength (KSI) | 237 | 228 | 230 | 230 |
| Yield Strength (KSI) | 187 | 182 | 200 | 186 |

TABLE 6-continued

| Example 1 of Alloy Steel No. 1 Thermal Treatment Parameters and Resulting Physical Properties | | | | |
|---|---|---|---|---|
| Condition ID | 1A | 1B | 1C | 1D |
| Elongation (%) | 15.2 | 13.1 | 15.1 | 14.2 |
| Reduction of area (%) | 60.2 | 55.1 | 62.3 | 60.2 |
| HRC | 43.2 | 46.3 | 45.1 | 40.4 |
| Charpy energy (ft.-lbs.), longitudinal, 72° F. | 52.4 | 45.0 | 44.3 | 48.9 |
| Charpy energy (ft.-lbs.), longitudinal, −4° F. | 49 | 49.3 | n/a | 51 |
| Charpy energy (ft.-lbs.), longitudinal, −49° F. | n/a | n/a | n/a | 48 |
| $K_{1C}$ Fracture Toughness (KSI $\sqrt{in}$) | n/a | n/a | n/a | 119 |
| U-Notched ($K_t$ = 1.5) Fatigue Strength (KSI) | n/a | n/a | n/a | 102 |

Figure 12:
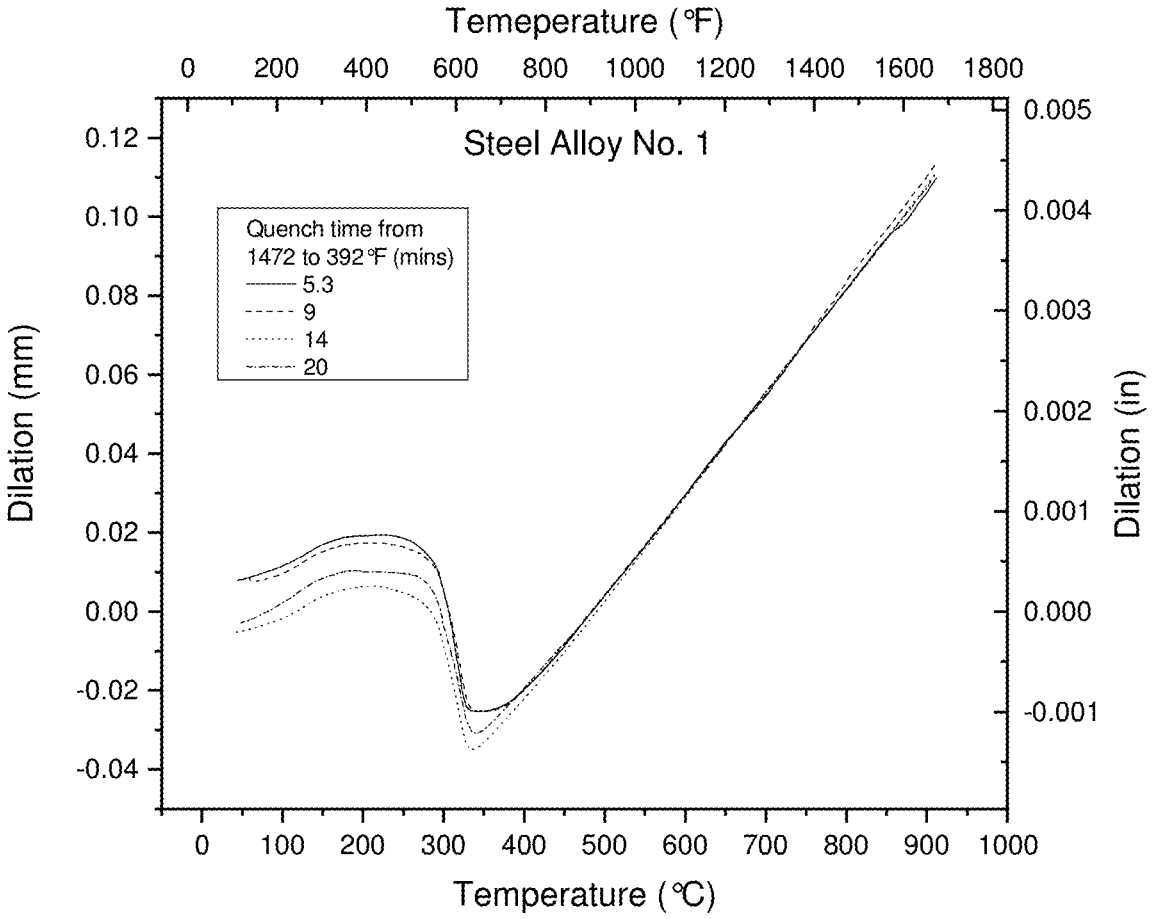
FIG. 12 is a graph showing the phase transformation dilation response on quenching for Example 1 of Inventive Alloy No. 1. Newtonian cooling profiles from 1472 to 392° F. at 5.3, 9, 14, and 20 minutes are shown.

The hardenability and ability to achieve the desired Charpy impact properties were evaluated using Gleeble® quench dilatometry with 0.433" square by 4" long blanks which had first been normalized at 1675° F. The center of the samples was heated to 1600° F. in the Gleeble®, held for 10 minutes, and then cooled along Newtonian cooling profiles characterized by the amount of time in minutes utilized to cool from 1472 to 392° F. As shown in FIG. 12, cooling Example 1 of Steel Alloy No. 1 at 5.3 or 9 minutes from 1472 to 392° F. resulted in a sharp martensitic transformation at 645° F. Cooling at 14 or 20 minutes from 1472 to 392° F. resulted in a trace of non-martensitic transformation between 740 and 645°.

Figure 15:
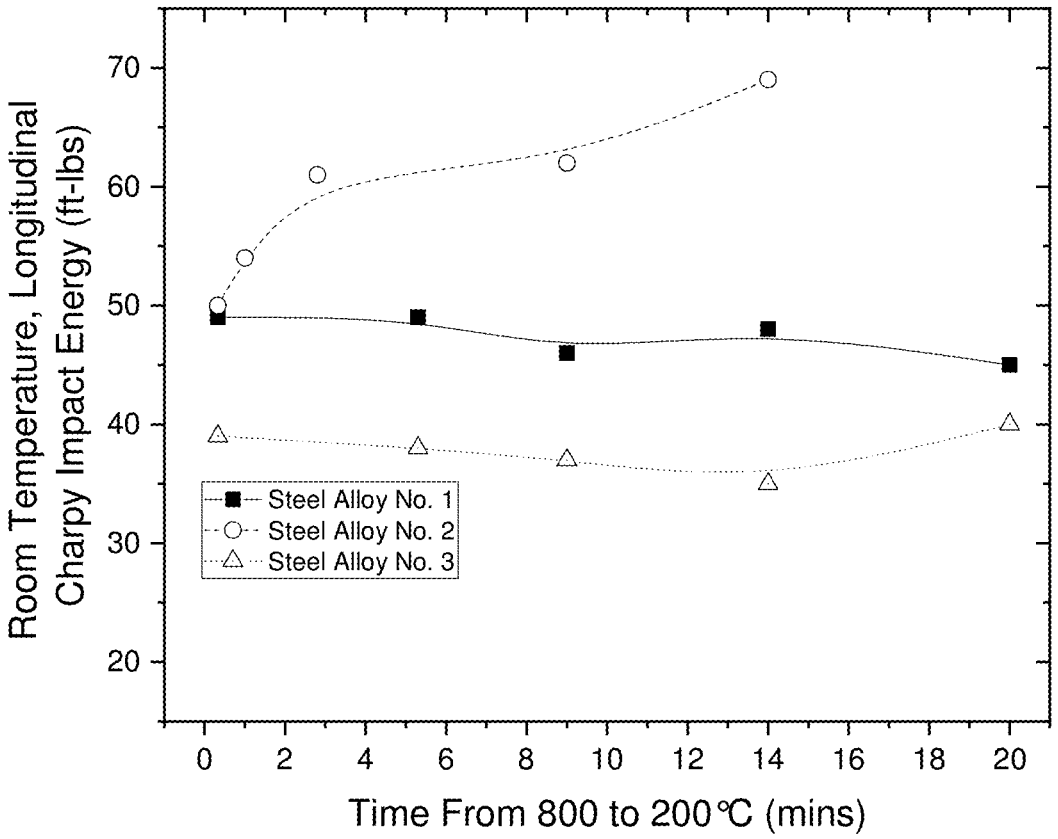
FIG. 15 shows the room temperature longitudinal Charpy impact values versus the cooling time from 1472 to 392° F. for the inventive alloys after the quenched dilation samples were tempered for 2.25 hours at 400° F.

After quenching on the dilatometer, the samples were tempered at 400° F. for 2.25 hours and then machined into standard Charpy impact samples. The room temperature Charpy impact values are plotted in FIG. 15. For cooling times from 5 to 20 minutes, the samples exhibited room temperature longitudinal Charpy impact values greater than 25 and as high as 47 ft.-lbs.

Example 2 of Alloy Steel No. 1—Electric Arc Furnace, Vacuum Ladle Refined

Approximately 240,000 lbs. of alloy steel having the chemical composition designated as Example 2 of Alloy Steel No. 1, shown in Table 7, was manufactured via an Electric Arc Furnace (EAF) melting, Vacuum Ladle Refining processing path. The steel was solidified in 28 inch square ingot molds, stripped from the ingot molds, hot rolled to billets, and hot rolled as bars with a range of bar diameters ranging from 3.75 to 13 inches.

TABLE 7

| Example 2 of Alloy Steel No. 1 | |
|---|---|
| Element | Percentage by Weight (%) |
| Carbon (C) | 0.28 |
| Manganese (Mn) | 0.55 |
| Silicon (Si) | 0.19 |
| Chromium (Cr) | 1.78 |
| Nickel (Ni) | 2.86 |
| Molybdenum (Mo) | 0.5 |
| Vanadium (V) | 0.008 |
| Niobium (Nb) | 0.004 |
| Aluminum (Al) | 0.016 |
| Nitrogen (N) | 0.0076 |
| Iron (Fe) | Balance |

Approximately 0.75 inch coupons were removed from the quarter section location of the 5.5" round bars in the longitudinal direction. Thermal treatment parameters and the resulting physical properties for Example 2 of Alloy Steel No. 1 are summarized in Table 8. All of the coupons were normalized at 1675° F. for 1 hour, air cooled, austenitized at 1600° F. for 1.25 hours, and water quenched. The samples were then tempered at 325 to 450° F. for 2.25 hours, and 500 to 750° F. for 1.25 hours as shown in Table 8.

Conditions 1E to 1K were tensile tested and exhibited ultimate tensile strengths greater than 200 KSI and as high as 245 KSI, yield strengths greater than 170 KSI and as high as 199 KSI. Percent elongation was greater than 13% and as high as 15%, and the reduction in area was greater than 40% and as high as 64%.

Conditions 1E to 1K were tested at room temperature (72° F.) and exhibited longitudinal Charpy impact energy values greater than 35 ft.-lbs. and as high as 41.3 ft.-lbs. when tempered at 500° F. and below (1E-1I). When tempered at 600 or 750° F. (1J and 1K), the room temperature longitudinal Charpy impact energy values were greater than 30 ft.-lbs.

Condition 1G was tested at −4 and −40° F. and exhibited longitudinal Charpy impact energy greater than 25 ft.-lbs. and as high as 37 ft.-lbs.

Condition 1J was tested at −4 and −40° F. and exhibited longitudinal Charpy impact energy greater than 20 ft.-lbs. and as high as 23 ft.-lbs.

Condition 1G was subjected to smooth sample rotating bending fatigue. FIG. 9 shows the smooth sample rotating bending fatigue data. The sample exhibited a smooth sample rotating bending fatigue strength run-out to $10^7$ cycles of 107 KSI.

TABLE 8

| Example 2 of Alloy Steel No. 1 Thermal Treatment Parameters and Resulting Physical Properties | | | | | | | |
|---|---|---|---|---|---|---|---|
| Condition ID | 1E | 1F | 1G | 1H | 1I | 1J | 1K |
| Temper Temperature | | | | | | | |
| Temper temp. (° F.) | 325 | 350 | 400 | 450 | 500 | 600 | 750 |
| Temper Time (hrs.) | 2.25 | 2.25 | 2.25 | 2.25 | 1.25 | 1.25 | 1.25 |
| Physical Properties | | | | | | | |
| Tensile Strength (KSI) | 245 | 241 | 232 | 223 | 219 | 211 | 201 |
| Yield Strength (KSI) | 199 | 196 | 189 | 184 | 181 | 178 | 175 |
| Elongation (%) | 15.0 | 15.0 | 15.0 | 15.0 | 15.0 | 15.0 | 15.0 |
| Reduction of area (%) | 60.0 | 60.0 | 60.5 | 62.0 | 62.5 | 64.0 | 62.5 |
| HRC | 48.4 | 48.6 | 47.8 | 44.4 | 44.4 | 43.3 | 42.4 |
| Charpy energy (ft.-lbs.), longitudinal, 72° F. | 39.3 | 39.0 | 38.7 | 41.3 | 39.3 | 33.7 | 33.0 |
| Charpy energy (ft.-lbs.), longitudinal, −4° F. | n/a | n/a | 37.3 | n/a | n/a | 23.0 | n/a |
| Charpy energy (ft.-lbs.), longitudinal, −40° F. | n/a | n/a | 34.7 | n/a | n/a | 22.0 | n/a |
| Smooth Sample Fatigue Strength (KSI) | n/a | n/a | 107.0 | n/a | n/a | n/a | n/a |

5.5" diameter bars were processed on production heat treatment equipment at TimkenSteel's Gambrinus Steel Plant. The bars were normalized at 1675° F. in a continuous tunnel furnace, air cooled, austenitized at 1600° F. and water quenched and tempered at 400° F. in the Advanced Quench and Temper Facility (AQTF). Longitudinal samples were sectioned from 1" below surface (MS) and the quarter section (QS) of the bars for mechanical property evaluation. The resulting physical properties for these samples of Example 2 of Alloy Steel No. 1 are summarized in Table 9.

Conditions 1L to 1M were tensile tested and exhibited ultimate tensile strengths greater than 200 KSI at each location tested, and as high as 217 KSI, and yield strengths greater than 170 KSI at each location tested and as high as 177 KSI. Elongation was 12% 1" below surface and at the quarter section. Reduction of area was greater than 35% and as high as 40% at 1" below surface and the quarter section.

Condition 1M was tested at room temperature and exhibited a longitudinal Charpy impact energy greater than 35 ft.-lbs. and as high as 37 ft.-lbs.

Condition 1L was tested at −49° F. and exhibited a longitudinal Charpy impact energy greater than 25 ft.-lbs. and as high as 37 ft.-lbs.

TABLE 9

| Condition ID<br>Sample Depth | 1L<br>1" below | 1M<br>Quarter section |
|---|---|---|
| Tensile Strength (KSI) | 215 | 215 |
| Yield Strength (KSI) | 175 | 175 |
| Elongation (%) | 12 | 12 |
| Reduction of area (%) | 40 | 38 |
| Charpy energy (ft.-lbs.), longitudinal, 72° F. | n/a | 37 |
| Charpy energy (ft.-lbs.), longitudinal, −49° F. | 38 | n/a |

A 1.5" by 5" wide by 12' long slab was heat treated at an external facility. The slab was normalized at 1675° F., air cooled, austenitized at 1600° F., water quenched, and tempered at 400° F. Samples were sectioned from the mid-thickness and tensile and longitudinal room temperature Charpy impact tests were performed. These samples exhibited average ultimate tensile strength of in excess of 200 KSI and as high as 237 KSI, a yield strength in excess of 170 KSI, and as high as 191 KIS, elongation greater than 12% and as high as 17.5%, and room temperature longitudinal Charpy impact energy in excess of 35 ft.-lbs. and as high as 50 ft.-lbs.

Example of Alloy Steel No. 2—Vacuum Induction Melted

Approximately 100 lbs. of a sample with a chemical composition designated as Alloy Steel No. 2, shown in Table 10, was manufactured in a vacuum induction melting facility and poured into an ingot mold. The approximate dimensions of the ingot were 5.5 inches in diameter and 13 inches long, yielding approximately 85 lbs. of material for testing. The ingot was forged along its axis to an approximately 2.25 inch square section yielding a total length of slightly less than about 5 feet. Saw cut test coupons were sectioned from the forged square bar for heat treatment and production of samples for tensile testing, Charpy impact testing, and rotating bending fatigue testing.

TABLE 10

| Alloy Steel No. 2 | |
|---|---|
| Element | Percentage by Weight (%) |
| Carbon (C) | 0.25 |
| Manganese (Mn) | 0.59 |
| Silicon (Si) | 0.20 |
| Chromium (Cr) | 2.23 |
| Nickel (Ni) | 0.07 |
| Molybdenum (Mo) | 1.0 |
| Vanadium (V) | 0.004 |
| Niobium (Nb) | 0.004 |
| Aluminum (Al) | 0.017 |
| Nitrogen (N) | 0.0094 |
| Iron (Fe) | Balance |

Thermal treatment parameters and the resulting physical properties for Alloy Steel No. 2 are summarized in Table 11. Three different thermal treatment conditions, identified as conditions 2A, 2B, and 2C, were produced and tested. Conditions 2A and 2B were not normalized and had different austenitizing and tempering temperatures. Condition 2C was normalized.

Figure 7:
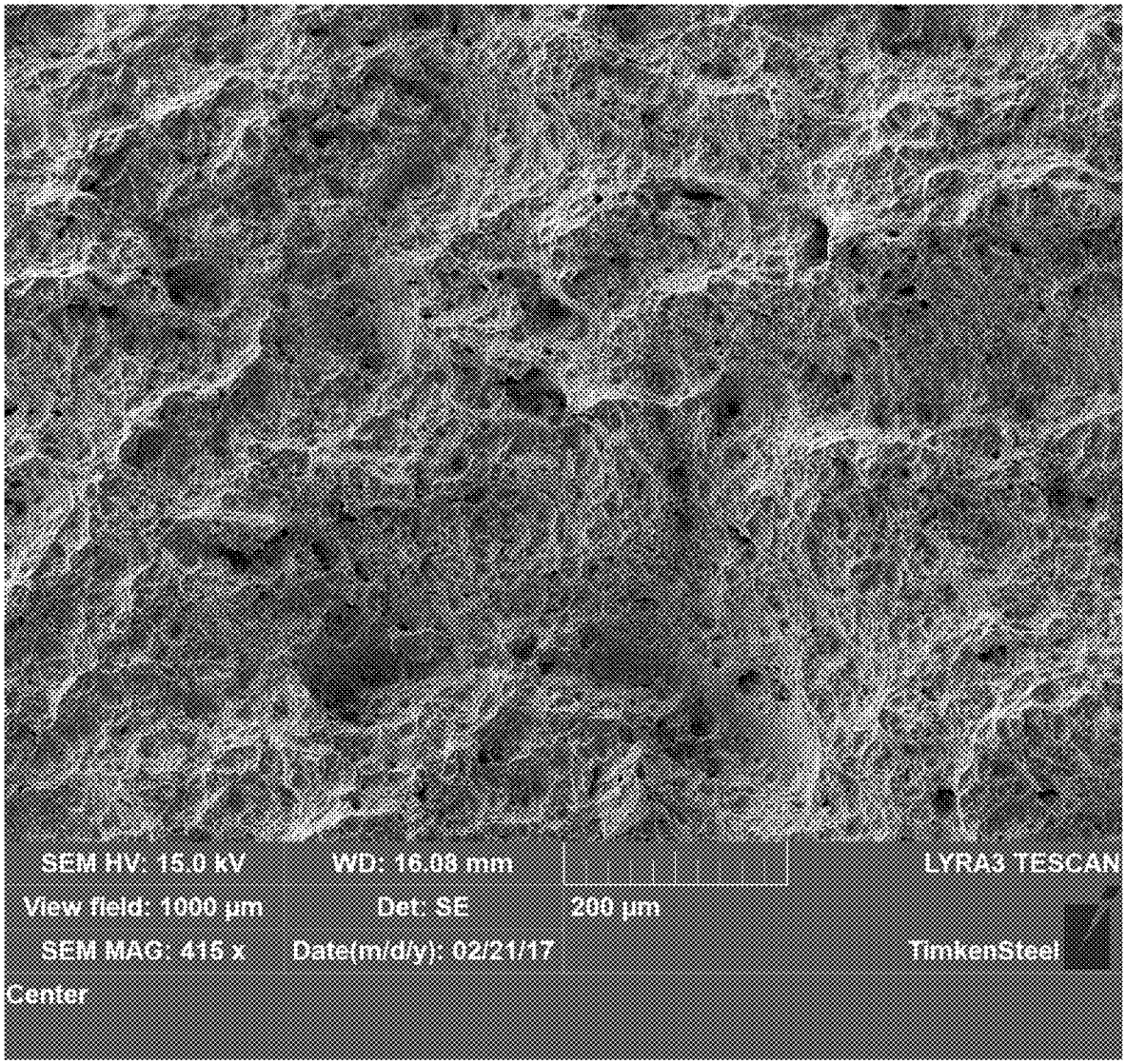
FIG. 7 shows a scanning electron microscopy (SEM) image from near the center of the Charpy fracture surface for Condition 2C (Table 11) of the Example of Steel Alloy No. 2. The sample orientation was longitudinal and the sample was broken at 72° F. The fracture consists entirely of tough ductile micro void coalescence with no evidence of brittle cleavage or intergranular fracture modes.

The non-normalized conditions (2A and 2B) exhibited yield strengths of 180 to 187 KSI and room temperature, longitudinal Charpy impact energy toughness of 45 ft.-lbs. The normalized condition (2C) exhibited a yield strength of 187 KSI and room temperature, longitudinal Charpy impact energy toughness of 49 ft.-lbs. FIG. 7 shows a scanning electron microscopy (SEM) image from near the center of the Charpy fracture surface for Steel Alloy No. 2 treated according Condition 2C. The sample orientation was longitudinal and the sample was broken at 72° F. The fracture consists entirely of tough ductile micro void coalescence with no evidence of brittle cleavage or intergranular fracture modes.

All three conditions (2A, 2B and 2C) were also tested at −4° F. and exhibited longitudinal Charpy impact energy toughness of 47 to 49 ft.-lbs. Condition 2C was also tested at −49° F. and exhibited longitudinal Charpy impact energy of about 42 ft.-lbs.

Condition 2C was also plane strain fracture toughness tested per ASTM E399 and exhibited a $K_{IC}$ fracture toughness of about 109 KSI$\sqrt{\text{in}}$.

Figure 10:
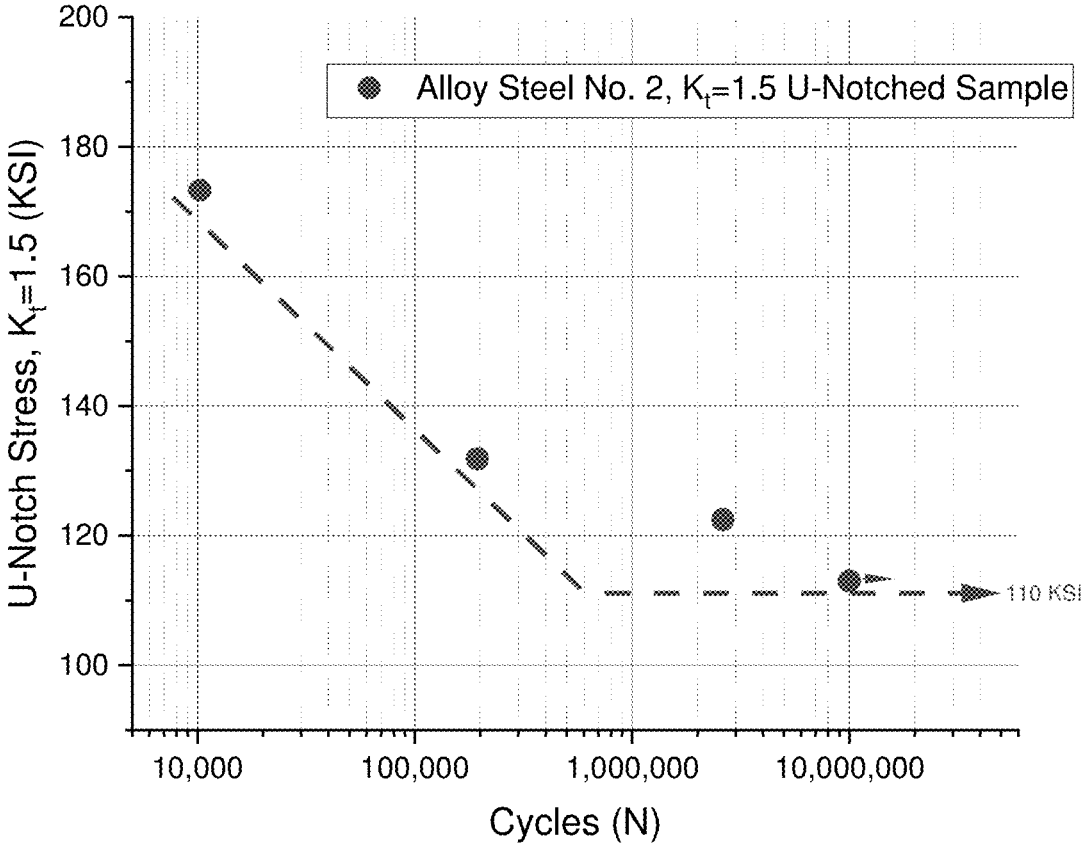
FIG. 10 is a graph showing the U-notched ($K_t$=1.5) rotating bending fatigue data for the Example of Inventive alloy No. 2.

Condition 2C was subjected to U-notched ($K_t$=1.5) rotating bending fatigue. FIG. 10 shows the U-notched rotating bending fatigue data. Testing was completed with a U-notched sample which had a stress concentration factor of 1.5. The stress presented is the applied stress multiplied by the U-notch stress concentration factor. The sample exhibited a fatigue strength run-out to $10^7$ cycles of 110 KSI.

TABLE 11

| Alloy Steel No. 2<br>Thermal Treatment Parameters and Resulting Physical Properties | | | |
|---|---|---|---|
| Condition ID | 2A | 2B | 2C |
| Thermal Treatment Parameters | | | |
| Normalize temp. (° F.) | n/a | n/a | 1675 |
| Normalize time (hrs.) | n/a | n/a | 1.25 |
| Austenitize temp. (° F.) | 1675 | 1650 | 1600 |
| Austenitize time (hrs.) | 1.25 | 1.25 | 1.25 |
| Quench medium | water | water | water |
| Temper temp. (° F.) | 350 | 400 | 400 |
| Temper time (hrs.) | 2.25 | 2.25 | 2.25 |
| Physical Properties | | | |
| Tensile Strength (KSI) | 233 | 228 | 232 |
| Yield Strength (KSI) | 187 | 180 | 187 |
| Elongation (%) | 13.7 | 14.6 | 14.1 |
| Reduction of area (%) | 56.95 | 55.0 | 60.75 |
| HRC | 46.9 | 48.6 | 44.1 |
| Charpy energy (ft.-lbs.), longitudinal, 72° F. | 45.8 | 45.3 | 49.8 |
| Charpy energy (ft.-lbs.), longitudinal, −4° F. | 46.7 | 41.7 | 48.9 |
| Charpy energy (ft.-lbs.), longitudinal, −49° F. | n/a | n/a | 42.2 |
| $K_{1C}$ Fracture Toughness (KSI $\sqrt{\text{in}}$) | n/a | n/a | 109 |
| U-Notched ($K_t$ = 1.5) Fatigue Strength (KSI) | n/a | n/a | 110 |

Figure 13:
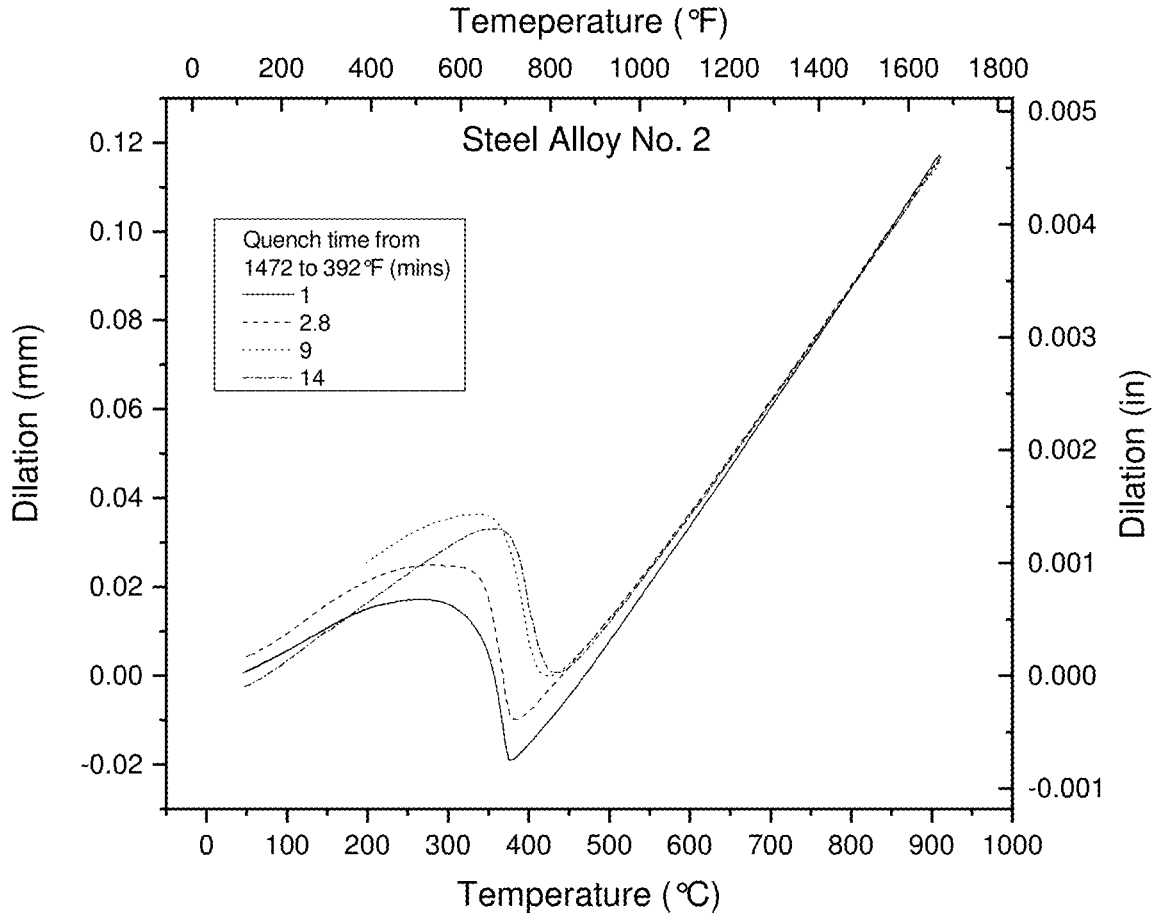
FIG. 13 is a graph showing the phase transformation dilation response on quenching for the Example Inventive Alloy No. 2. Newtonian cooling profiles from 1472 to 392° F. at 5.3, 9, 14, and 20 minutes are shown.

The hardenability and ability to achieve the desired Charpy impact properties were evaluated using Gleeble® quench dilatometry with 0.433" square by 4" long blanks which had first been normalized at 1675° F. The center of the samples was heated to 1600° F. in the Gleeble®, held for 10 minutes, and then cooled along Newtonian cooling profiles characterized by the amount of time in minutes utilized to cool from 1472 to 392° F. As shown in FIG. 13, cooling Steel Alloy No. 2 at 1 or 2.8 minutes from 1472 to 392° F. resulted in a sharp martensitic transformation at 720° F. Cooling at 9 or 14 minutes from 1472 to 392° F. resulted in a trace of non-martensitic transformation between 843 and 720° F., with some martensite forming after 720° F.

After quenching on the dilatometer, the samples were tempered at 400° F. for 2.25 hours and then machined into standard Charpy impact samples. The room temperature Charpy impact values are plotted in FIG. 15. For cooling times from 2 to 14 minutes, the samples exhibited room temperature longitudinal Charpy impact values greater than 35 and as high as 60 ft.-lbs. and 65 ft.-lbs.

Example 1 of Alloy Steel No. 3—Electric Arc Furnace, Vacuum Ladle Refined

Approximately 240,000 lbs. of alloy steel with a chemical composition designated as Example 1 of Alloy Steel No. 3, shown in Table 12, was manufactured via an Electric Arc Furnace (EAF) melting, Vacuum Ladle Refining processing path. The steel was solidified in 28 inch square ingot molds, stripped from the ingot molds, hot rolled to billets, and hot formed as seamless mechanical tubing with a 7.50 inch outer diameter and 2.25 inch wall thickness. Saw cut test coupons were sectioned from the mid-wall of the tube for heat treatment and production of samples for tensile testing, Charpy impact testing, and rotating bending fatigue testing.

TABLE 12

Example 1 of Alloy Steel No. 3

| Element | Percentage by Weight (%) |
|---|---|
| Carbon (C) | 0.29 |
| Manganese (Mn) | 0.90 |
| Silicon (Si) | 0.26 |
| Chromium (Cr) | 0.80 |
| Nickel (Ni) | 0.80 |
| Molybdenum (Mo) | 0.80 |
| Vanadium (V) | 0.005 |
| Niobium (Nb) | 0.028 |
| Aluminum (Al) | 0.035 |
| Nitrogen (N) | 0.0077 |
| Iron (Fe) | Balance |

Thermal treatment parameters and the resulting physical properties for Alloy Steel No. 3 are summarized in Table 13. Three different thermal treatment conditions, identified as conditions 3A, 3B, and 3C, were produced and tested. Condition 3A was not normalized. Conditions 3B and 3C were normalized and received the same thermal treatments with the exception that 3B was quenched first in water and then in liquid nitrogen until the liquid nitrogen ceased boiling and condition 3C was only quenched in water.

Figure 8:
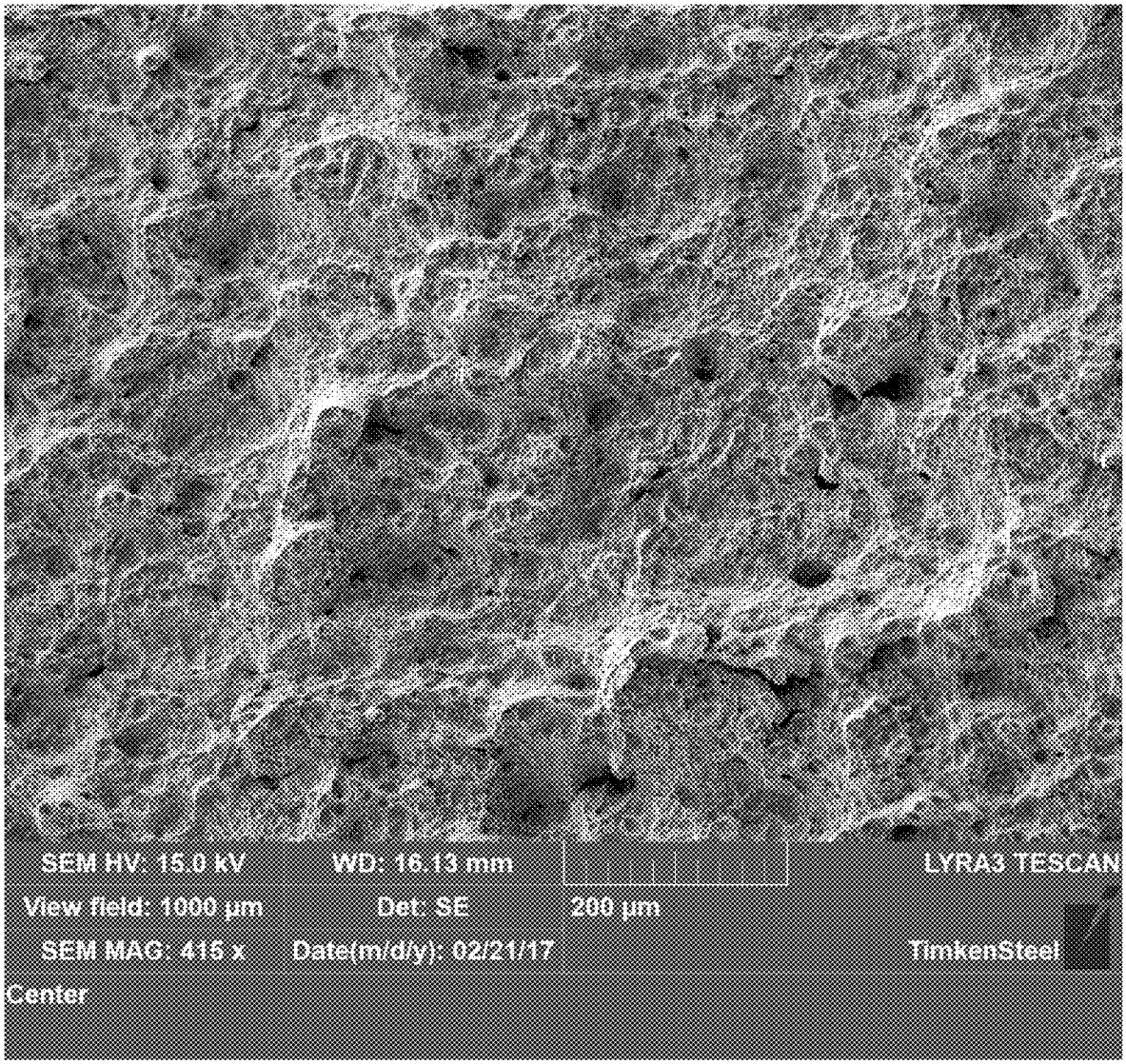
FIG. 8 shows a scanning electron microscopy (SEM) image from near the center of the Charpy fracture surface for Condition 3C (Table 13) of Example 1 of Steel Alloy No. 3. The sample orientation was longitudinal and the sample was broken at 72° F. The fracture consists entirely of tough ductile micro void coalescence with no evidence of brittle cleavage or intergranular fracture modes.

The non-normalized condition 3A exhibited yield strength of 204 KSI and room temperature, longitudinal Charpy impact energy of 39 ft.-lbs. The normalized conditions (3B and 3C) exhibited yield strengths of 210 to 214 KSI and room temperature, longitudinal Charpy impact energy toughness of 41 to 42 ft.-lbs. FIG. 8 shows a scanning electron microscopy (SEM) image from near the center of the Charpy fracture surface for Steel Alloy No. 3 treated according Condition 3C. The sample orientation was longitudinal and the sample was broken at 72° F. The fracture consists entirely of tough ductile micro void coalescence with no evidence of brittle cleavage or intergranular fracture modes.

Condition 3C was also tested at −4° F. and −49° F., and exhibited longitudinal Charpy impact energy toughness of about 37 ft.-lbs. and 36 ft.-lbs., respectively.

Condition 3C was also plane strain fracture toughness tested per ASTM E399 and exhibited a $K_{IC}$ fracture toughness of about 113 KSI$\sqrt{in}$.

Figure 11:
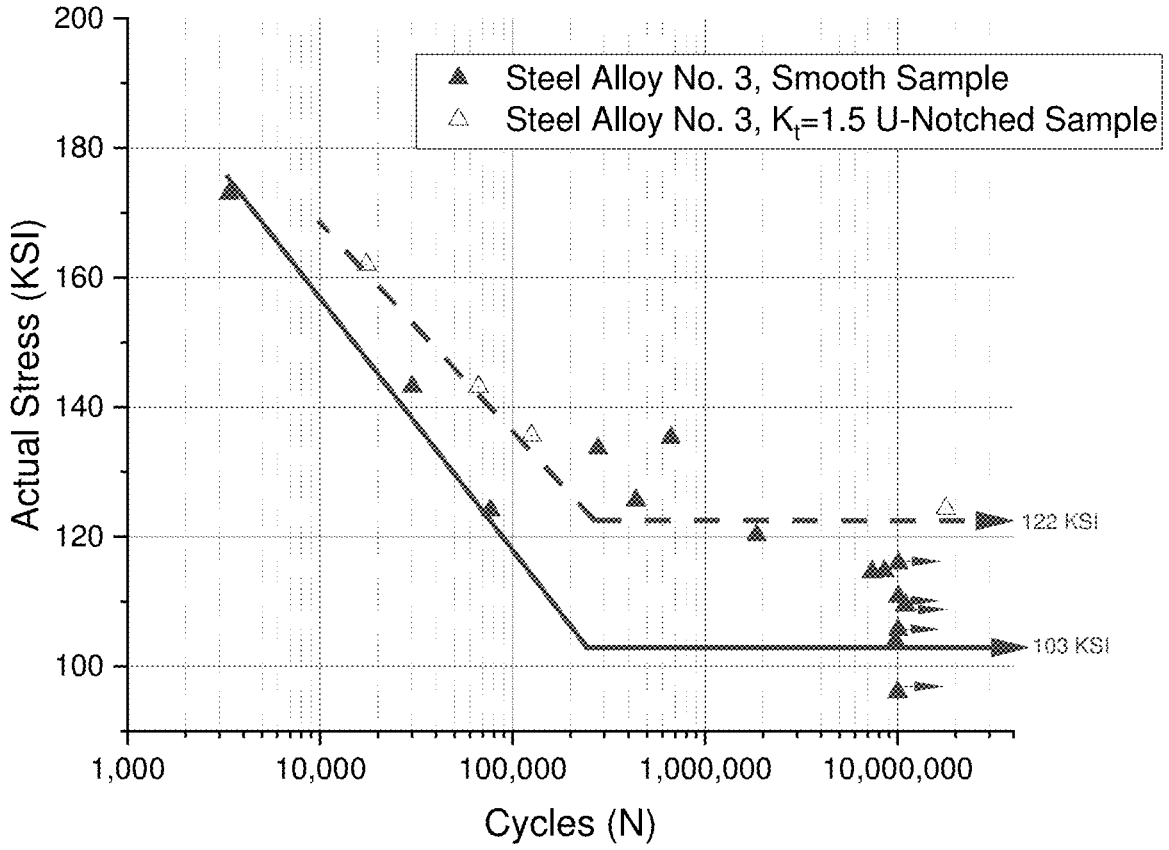
FIG. 11 is a graph showing the smooth sample and U-notched ($K_t$=1.5) rotating bending fatigue data for Examples 1 and 2 of Inventive Alloy No. 3, respectively

Condition 3C was subjected to U-notched rotating bending fatigue. FIG. 11 shows the U-notched rotating bending fatigue data. Testing was completed with a U-notched sample which had a stress concentration factor of 1.5. The stress presented is the applied stress multiplied by the U-notch stress concentration factor. The sample exhibited a fatigue strength run-out to $10^7$ cycles of 122 KSI.

TABLE 13

Alloy Steel No. 3 Thermal Treatment Parameters and Resulting Physical Properties

| Condition ID | 3A | 3B | 3C |
|---|---|---|---|
| Thermal Treatment Parameters | | | |
| Normalize temp. (° F.) | n/a | 1675 | 1675 |
| Normalize time (hrs.) | n/a | 1.25 | 1.25 |
| Austenitize temp. (° F.) | 1675 | 1600 | 1600 |
| Austenitize time (hrs.) | 1.25 | 1.25 | 1.25 |
| Quench medium | water | liq. nit. | water |
| Temper temp. (° F.) | 400 | 400 | 400 |
| Temper time (hrs.) | 2.25 | 2.25 | 2.25 |
| Physical Properties | | | |
| Tensile Strength (KSI) | 244 | 252 | 250 |
| Yield Strength (KSI) | 204 | 214 | 210 |
| Elongation (%) | 14.0 | 13.1 | 12.2 |
| Reduction of area (%) | 55.8 | 55.05 | 54.7 |
| HRC | 47.5 | 44.0 | 45.4 |
| Charpy energy (ft.-lbs.), longitudinal, 72° F. | 39.1 | 42.0 | 41.0 |
| Charpy energy (ft.-lbs.), longitudinal, −4° F. | n/a | n/a | 36.7 |
| Charpy energy (ft.-lbs.), longitudinal, −49° F. | n/a | n/a | 36.3 |
| $K_{1C}$ Fracture Toughness (KSI $\sqrt{in}$) | n/a | n/a | 113 |
| U-Notched ($K_t$ = 1.5) Fatigue Strength (KSI) | n/a | n/a | 122 |

Approximately 0.75" coupons were removed from the mid-wall location of the 2.25" wall of the tubes in the longitudinal direction. Thermal treatment parameters and the resulting physical properties for these samples of Example 1 of Alloy Steel No. 3 are summarized in Table 14. All of the coupons were normalized at 1675° F. for 1 hour, air cooled, austenitized at 1600° F. for 1.25 hours, and water quenched. The samples were then tempered at 325 to 450° F. for 2.25 hours, and 500 to 750° F. for 1.25 hours as shown in Table 14.

Conditions 3D to 3I were tensile tested and exhibited ultimate tensile strengths greater than 235 KSI and as high as 264 KSI, and yield strengths greater than 195 KSI and as high as 217 KSI. Percent elongation was greater than 12% and as high as 14.2%, and the reduction in area was greater than 40% and as high as 56%.

Conditions 3D to 3I were tested at room temperature (72° F.) and exhibited longitudinal Charpy impact energy values greater than 30 ft.-lbs. and as high as 38 ft.-lbs.

Conditions 3F was tested at −4 and −40° F. and exhibited longitudinal Charpy impact energy greater than 25 ft.-lbs. and as high as 31.7 ft.-lbs.

TABLE 14

| Alloy Steel No. 3 Thermal Treatment Parameters and Resulting Physical Properties | | | | | | |
|---|---|---|---|---|---|---|
| Condition ID | 3D | 3E | 3F | 3G | 3H | 3I |
| Temper Temperature | | | | | | |
| Temper temp. (° F.) | 325 | 350 | 400 | 450 | 500 | 600 |
| Temper Time (hrs.) | 2.25 | 2.25 | 2.25 | 2.25 | 1.25 | 1.25 |
| Physical Properties | | | | | | |
| Tensile Strength (KSI) | 264 | 261 | 253 | 241 | 243 | 231 |
| Yield Strength (KSI) | 215 | 217 | 214 | 207 | 207 | 207 |
| Elongation (%) | 13.3 | 12.8 | 14.2 | 13.5 | 13.0 | 13.3 |
| Reduction of area (%) | 50.5 | 49.5 | 54.5 | 56.0 | 54.0 | 59.0 |
| HRC | 47.3 | 48.2 | 48.0 | 47.5 | 46.5 | 46.2 |
| Charpy energy (ft.-lbs.), longitudinal, 72° F. | 30.7 | 32.7 | 38.0 | 36.7 | 33.7 | 37.3 |
| Charpy energy (ft.-lbs.), longitudinal, −4° F. | n/a | n/a | 31.7 | n/a | n/a | 23.3 |
| Charpy energy (ft.-lbs.), longitudinal, −40° F. | n/a | n/a | 31 | n/a | n/a | 20.7 |

Figure 14:
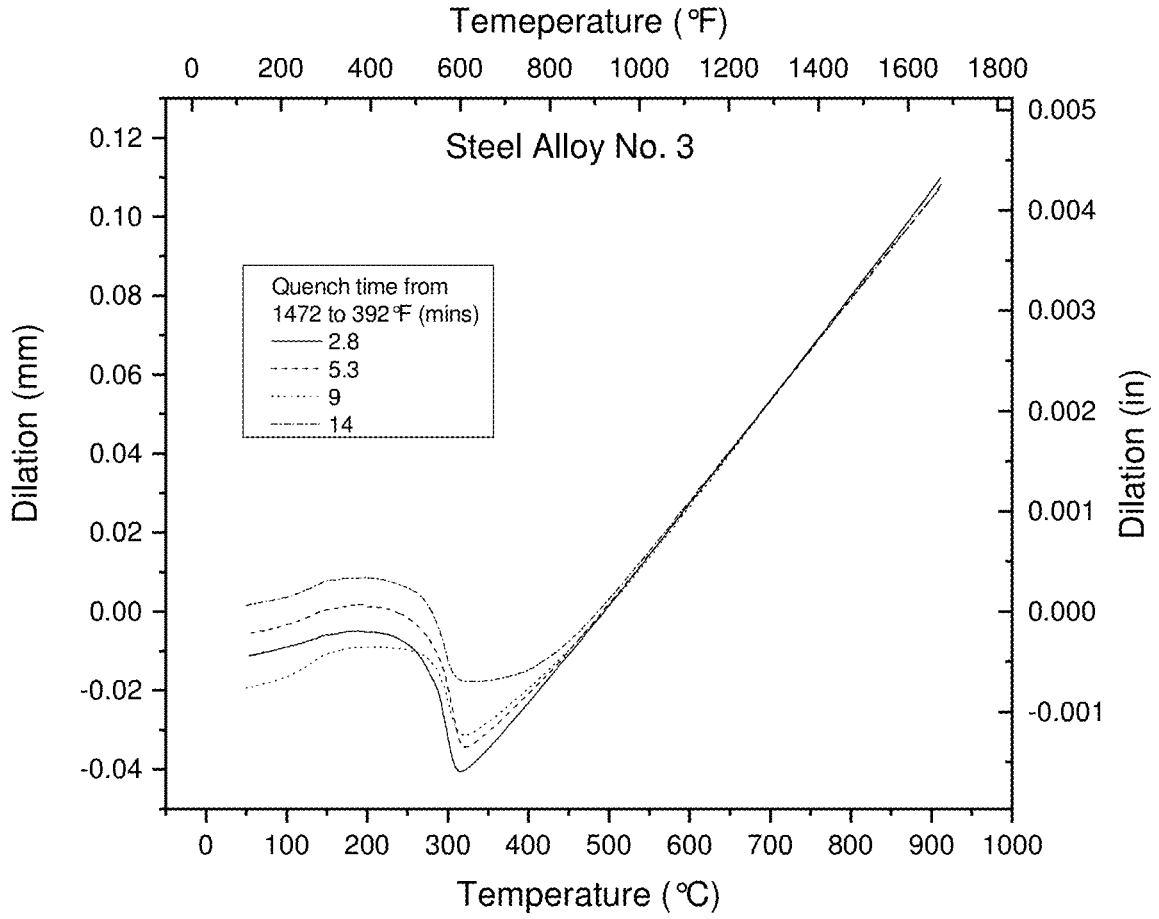
FIG. 14 is a graph showing the phase transformation dilation response on quenching for Example 1 of Inventive Alloy No. 3. Newtonian cooling profiles from 1472 to 392° F. at 5.3, 9, 14, and 20 minutes are shown.

The hardenability and ability to achieve the desired Charpy impact properties were evaluated using Gleeble® quench dilatometry with 0.433" square by 4" long blanks which had first been normalized at 1675° F. The center of the samples was heated to 1600° F. in the Gleeble®, held for 10 minutes, and then cooled along Newtonian cooling profiles characterized by the amount of time in minutes utilized to cool from 1472 to 392° F. As shown in FIG. 14, cooling Steel Alloy No. 2 at 1 or 2.8 minutes from 1472 to 392° F. resulted in a sharp martensitic transformation at 600° F. Cooling at 5.3 or 9 minutes from 1472 to 392° F. resulted in some non-martensitic transformation occurring between 830 and 600° F., with mostly martensite forming after 600° F. Cooling at 14 minutes from 1472 to 392° F. resulted in a significant amount of non-martensitic transformation occurring between 870 and 600° F. with more than half transforming to martensite.

After quenching on the dilatometer, the samples were tempered at 400° F. for 2.25 hours and then machined into standard Charpy impact samples. The room temperature Charpy impact values are plotted in FIG. 15. For cooling times from 5 to 20 minutes, the samples exhibited room temperature longitudinal Charpy impact values greater than 25 and as high as 35 ft.-lbs.

Example 2 of Alloy Steel No. 3—Electric Arc Furnace, Vacuum Ladle Refined

Approximately 240,000 lbs. of alloy steel with a chemical composition designated as Example 2 of Alloy Steel No. 3, shown in Table 15, was manufactured via an Electric Arc Furnace (EAF) melting, Vacuum Ladle Refining processing path. The steel was solidified in 28 inch square ingot molds, stripped from the ingot molds, and hot rolled to round bars ranging from 3.75" to 11" in diameter and round cornered square bars 5.116" square.

TABLE 15

| Example 2 of Alloy Steel No. 3 | |
|---|---|
| Element | Percentage by Weight (%) |
| Carbon (C) | 0.28 |
| Manganese (Mn) | 0.90 |
| Silicon (Si) | 0.26 |
| Chromium (Cr) | 0.80 |

TABLE 15-continued

| Example 2 of Alloy Steel No. 3 | |
|---|---|
| Element | Percentage by Weight (%) |
| Nickel (Ni) | 0.81 |
| Molybdenum (Mo) | 0.80 |
| Vanadium (V) | 0.005 |
| Niobium (Nb) | 0.03 |
| Aluminum (Al) | 0.016 |
| Nitrogen (N) | 0.0077 |
| Iron (Fe) | Balance |

Saw cut test coupons were sectioned from the quarter section of a hot rolled and normalized 5.5" round bar. The bar was normalized in TimkenSteel production facilities at the Gambrinus Steel Plant at 1675° F. Samples were sectioned, austenitized at 1600° F. for 1 hour, quenched in water, and tempered at 400° F. for 2.25 hours. Samples were produced for tensile testing, Charpy impact testing, and smooth sample rotating bending fatigue testing.

The tensile samples exhibited an ultimate tensile strength in excess of 235 KSI and up to 239 KSI, a yield strength in excess of 195 KSI and up to 201 KSI, elongation greater than 12% and up to 14.5%, and a reduction of area greater than 40% and up to 62%.

Samples tested at room temperature exhibited longitudinal Charpy impact energy toughness of greater than 30 ft.-lbs. and up to 57 ft.-lbs.

Smooth sample rotating bending fatigue samples were tested and the results are plotted in FIG. 11. The fatigue tests exhibited a smooth sample rotating bending fatigue strength run-out to $10^7$ cycles of 103 KSI.

A 3.75" round bar was normalized at 1675° F. and air cooled, austenitized at 1600° F. for 2 hours, water quenched, and tempered at 500° F. for 4 hours at an external heat treat source. Samples were machined from the quarter section, and tensile and Charpy impact testing was performed. The tensile tests exhibited an ultimate tensile strength of 242 KSI, a yield strength of 203 KSI, an elongation of 15.5%, and reduction of area of 54.5%. Room temperature Charpy impact tests exhibited a longitudinal impact energy of 31 ft.-lbs.

A 5.116" round cornered square bar was forged into a shape with various cross sections, normalized at 1675° F., air cooled, austenitized at 1600° F., quenched in a water and polymer mixture, and tempered at 400° F. Tensile and Charpy impact samples were removed from the center of a 2.95" thick section of the forging and exhibited an ultimate tensile strength of 247 KSI, a yield strength of 201 KSI, and a −49° F. Charpy impact energy of 37.6 ft.-lbs.

Whereas particular aspects of this invention have been described above for purposes of illustration, it will be evident to those skilled in the art that numerous variations of the details of the present invention may be made without departing from the invention as defined in the appended claims.

The invention claimed is:

1. An alloy steel consisting of, by weight:

0.24% to 0.32% carbon;

1.0% manganese or less;

0.45% silicon or less;

1.60% to 1.85% chromium;

2.5% to 3.1% nickel;

0.40% to 0.65% molybdenum;

0.025% to 0.05% vanadium; and 0.01% niobium or less, the balance being iron and unavoidable impurities, wherein the room temperature, longitudinal Charpy impact energy toughness is 35 ft.-lbs. or more.

2. The alloy steel of claim 1, wherein the ultimate tensile strength is 200 KSI or more, the 0.2% offset yield strength is 170 KSI or more, and the hardness on the Rockwell C scale is 40 or more.

3. The alloy steel of claim 1, wherein the −40° F., longitudinal Charpy impact energy toughness is 25 ft.-lbs. or more.

4. The alloy steel of claim 1, wherein the elongation to failure is 12% or more and the reduction of area at failure is 35% or more.

5. The alloy steel of claim 1, wherein the smooth sample rotating bending fatigue strength is 85 KSI or more.

6. The alloy steel of claim 1, wherein the microstructure of the alloy steel comprises at least 90% martensite.

7. The alloy steel of claim 1, wherein the unavoidable impurities include, in weight %, 0.035% or less aluminum, 0.012% or less nitrogen, 0.25% or less copper, 0.025% or less sulfur, 0.002% or less Ca, 0.0015% or less oxygen, 0.012% or less phosphorus, 0.012% or less tin, 0.012% or less arsenic and 0.012% or less antimony.

8. An alloy steel consisting of, by weight:

0.23% to 0.28% carbon;

1.0% manganese or less;

0.45% silicon or less;

2.05% to 2.4% chromium;

0.35% or less nickel;

0.85% to 1.15% molybdenum;

0.03% or less vanadium; and 0.01% niobium or less, the balance being iron and unavoidable impurities.

9. The alloy steel of claim 8, wherein the ultimate tensile strength is 220 KSI or more, the 0.2% offset yield strength is 175 KSI or more, the hardness on the Rockwell C scale is 42 or more.

10. The alloy steel of claim 8, wherein the room temperature, longitudinal Charpy impact energy toughness is 35 ft.-lbs. or more and the −49° F., longitudinal Charpy impact energy toughness is 35 ft.-lbs. or more.

11. The alloy steel of claim 8, wherein the elongation to failure is 13% or more and the reduction of area at failure is 40% or more.

12. The alloy steel of claim 8, wherein the U-notched rotating bending fatigue strength when $K_t$=1.5 is 90 KSI or more.

13. The alloy steel of claim 8, wherein the microstructure of the alloy steel comprises at least 90% martensite.

14. The alloy steel of claim 8, wherein the unavoidable impurities include, in weight percent, 0.035% or less aluminum, 0.012% or less nitrogen, 0.25% or less copper, 0.025% or less sulfur, 0.002% or less Ca, 0.0015% or less oxygen, 0.012% or less phosphorus, 0.012% or less tin, 0.012% or less arsenic and 0.012% or less antimony.

15. An alloy steel consisting of, by weight:

0.27% to 0.32% carbon;

1.0% manganese or less;

0.45% silicon or less;

0.7% to 1.0% chromium;

0.7% to 1.0% nickel;

0.7% to 1.0% molybdenum;

0.05% or less vanadium; and 0.05% or less niobium, the balance being iron and unavoidable impurities, wherein the room temperature, longitudinal Charpy impact energy toughness is 30 ft.-lbs. or more.

16. The alloy steel of claim 15, wherein the ultimate tensile strength is 235 KSI or more, the 0.2% offset yield strength is 195 KSI or more, and the hardness on the Rockwell C scale is 42 or more.

17. The alloy steel of claim 15, wherein the −40° F., longitudinal Charpy impact energy toughness is 25 ft.-lbs. or more.

18. The alloy steel of claim 15, wherein the elongation to failure is 12% or more and the reduction of area at failure is 40% or more.

19. The alloy steel of claim 15, wherein the smooth sample rotating bending fatigue strength is 80 KSI or more.

20. The alloy steel of claim 15, wherein the microstructure of the alloy steel comprises at least 90% martensite.

21. The alloy steel of claim 15, wherein the unavoidable impurities include, in weight %, 0.035% or less aluminum, 0.012% or less nitrogen, 0.25% or less copper, 0.025% or less sulfur, 0.002% or less Ca, 0.0015% or less oxygen, 0.012% or less phosphorus, 0.012% or less tin, 0.012% or less arsenic and 0.012% or less antimony.

* * * * *